US008407955B2

(12) United States Patent
Delforte

(10) Patent No.: US 8,407,955 B2
(45) Date of Patent: Apr. 2, 2013

(54) REMOVABLE HIGHLY SECURED HIGH IMPACT WALL PANELS MOUNTING SYSTEM

(76) Inventor: Paul Delforte, Victor, NY (US)

( * ) Notice: Subject to any disclaimer, the term of this patent is extended or adjusted under 35 U.S.C. 154(b) by 143 days.

(21) Appl. No.: 13/099,480

(22) Filed: May 3, 2011

(65) Prior Publication Data

US 2012/0192518 A1 Aug. 2, 2012

Related U.S. Application Data

(60) Provisional application No. 61/438,671, filed on Feb. 2, 2011, provisional application No. 61/444,716, filed on Feb. 19, 2011.

(51) Int. Cl.

| | |
|---|---|
| ***E04H 1/00*** | (2006.01) |
| ***E04H 3/00*** | (2006.01) |
| ***E04F 13/08*** | (2006.01) |
| ***E04C 3/00*** | (2006.01) |
| ***E04B 2/30*** | (2006.01) |
| ***E04B 2/00*** | (2006.01) |

(52) U.S. Cl. ..... 52/235; 52/385; 52/460; 52/489.1; 52/506.06; 52/582.1

(58) Field of Classification Search ..... 52/202, 52/235, 384, 385, 459, 460, 461, 489.1, 764, 52/507, 716.8, 506.06, 506.05, 582.1
See application file for complete search history.

(56) References Cited

U.S. PATENT DOCUMENTS

| | | | | | |
|---|---|---|---|---|---|
| 1,335,301 | A | * | 3/1920 | Stoddard | 52/474 |
| 3,295,282 | A | * | 1/1967 | Belcher, Jr. | 52/460 |
| 3,335,530 | A | * | 8/1967 | Hurd | 52/18 |
| 3,359,700 | A | * | 12/1967 | Birum, Jr. | 52/468 |
| 4,744,189 | A | | 5/1988 | Wilson | |
| 4,796,397 | A | | 1/1989 | Capaul | |
| 4,934,119 | A | * | 6/1990 | Ybarra | 52/238.1 |
| 5,247,769 | A | * | 9/1993 | Becker | 52/506.06 |
| 5,709,058 | A | * | 1/1998 | Shaw | 52/404.1 |
| 5,881,522 | A | * | 3/1999 | Dobija | 52/506.01 |
| 5,974,753 | A | * | 11/1999 | Hsu | 52/506.01 |
| 6,202,377 | B1 | * | 3/2001 | Krieger | 52/489.1 |
| 6,289,646 | B1 | * | 9/2001 | Watanabe | 52/506.01 |
| 6,627,290 | B2 | * | 9/2003 | Wittlinger et al. | 428/95 |
| 6,748,709 | B1 | * | 6/2004 | Sherman et al. | 52/235 |

(Continued)

*Primary Examiner* — Ryan Kwiecinski
(74) *Attorney, Agent, or Firm* — Tracy Jong Law Firm; Tracy P. Jong; Cheng Ning Jong

(57) ABSTRACT

A removable highly secured high impact wall panel mounting system for mounting at least one wall panel having a front face, a rear face and at least one first attachment portion attached to a portion of the rear face, to a wall in an area of high traffic, comprising at least one second attachment portion and at least one joint closure having an elongated strip. In some embodiments, the joint closure further comprises a plurality of pairs of flanges. In another embodiment, the joint closure further comprises an elongated bottom plate. The elongated strip includes a longitudinal axis and a substantially rectangular cross-sectional profile including a top wall, a bottom wall and two side walls connecting the top wall to the bottom wall. Each pair of flanges is disposed substantially symmetrically about the longitudinal axis of the strip. Each flange is substantially an isosceles trapezoid and comprises a top surface, a weakened base and two inwardly pointing sides extending from each end of the weakened base. In one embodiment, a through slot is disposed substantially centrally about the top surface. In another embodiment, at least one screw opening, at least one plate opening and at least one securing plate is provided. At least one second attachment portion is attached to a portion of a flange and the first attachment portion is configured to be removably attachable to the at least one second attachment portion. A vacuum lifter is further provided to make removal of the wall panel easier.

14 Claims, 20 Drawing Sheets

U.S. PATENT DOCUMENTS

| | | | | |
|---|---|---|---|---|
| 6,751,922 | B1 * | 6/2004 | Auriemma | 52/506.05 |
| 6,988,343 | B2 * | 1/2006 | Gleeson et al. | 52/459 |
| 7,587,869 | B2 * | 9/2009 | Lahni | 52/235 |
| 7,596,911 | B2 * | 10/2009 | Turco | 52/127.6 |
| 7,694,478 | B2 * | 4/2010 | Zahner | 52/302.3 |
| 7,805,899 | B2 * | 10/2010 | Montgomery | 52/235 |
| 8,127,507 | B1 * | 3/2012 | Bilge | 52/235 |
| 8,196,367 | B2 * | 6/2012 | De Bray | 52/549 |
| 2002/0023398 | A1 * | 2/2002 | Ito | 52/220.1 |
| 2004/0010998 | A1 * | 1/2004 | Turco | 52/762 |
| 2005/0060950 | A1 * | 3/2005 | Hauschildt et al. | 52/235 |
| 2006/0201084 | A1 * | 9/2006 | Arias | 52/235 |
| 2006/0265988 | A1 * | 11/2006 | Fujito et al. | 52/511 |
| 2010/0083599 | A1 * | 4/2010 | Meulemans | 52/287.1 |
| 2012/0055109 | A1 * | 3/2012 | Labonte et al. | 52/506.05 |
| 2012/0085046 | A1 * | 4/2012 | Proctor | 52/235 |

* cited by examiner

REMOVABLE HIGHLY SECURED HIGH IMPACT WALL PANELS MOUNTING SYSTEM

This non-provisional application claims priority to provisional application U.S. Ser. No. 61/438,671 filed Feb. 2, 2011 and provisional application U.S. Ser. No. 61/444,716 filed Feb. 19, 2011. Said applications are incorporated by reference herein in their entirety.

BACKGROUND OF THE INVENTION

1. The Field of the Invention

The present invention is directed generally to a wall panel mounting system, and more particularly, to a removable highly secured wall panel mounting system that is installable and removable by hand.

2. Background Art

Wall coverings have been in use for many years to decorate walls, hide imperfections, provide acoustical and thermal insulation, and protect walls from moisture and impact damage. Conventional wall coverings such as wall paper, paint and nailed-on wood or screwed-on synthetic panels are used in many residential and commercial applications. However, there are many well-known drawbacks to these prior art wall covering solutions. In order to remove a permanently nailed-on wall panel, a pry bar is conventionally used. The use of a pry bar causes dents and divots in underlying walls. Permanently screwed-on panels typically require overlaps in order to conceal screws or other fastening devices from plain sight. A system employing overlapped panels is plagued by the need to install or remove the panels in a fixed order. Therefore, removal and replacement of a damaged panel involves an undue amount of time, effort and labor cost.

Some panel mounting systems have been invented, but they suffer from insecure attachment. The wall panels become easily detached when bumped or knocked with any reasonable amount of force.

Another drawback of wall panels installed by nails and screws is a potential health hazard. Wall panels installed with their rear face coming in abutment with the underlying walls tend to trap moisture between the panel and wall, encouraging mold growth.

Several individually removable wall panel mounting solutions have been attempted to solve several of the above problems. However, none of the prior art discloses a satisfactory solution where moisture build-up is inhibited while wall panels can be securely attached to a wall without risk of intentional or accidental detachment.

U.S. Pat. No. 4,744,189 to Wilson discloses a decorative wall panel including a fabric covering on a board removably secured to an existing wall. The rear of the board carries a plurality of "VELCRO" fasteners for cooperation with corresponding fasteners on the wall. The panels may be easily secured to the wall, such as a dry wall partition, and may be just as easily removed whenever desired. The '189 disclosure fails to teach a removably attachable wall panel covering system that is tamper resistant. In column 1 lines 10-11 of the '189 patent, it has been disclosed that the removable wall panel can be conveniently removed from the wall by a simple pulling action. As such, a panel according to the '189 disclosure may only be used in a low traffic area for fear of accidental detachment and falling of a panel. It is further disclosed that the panels are secured to walls with fibrous fasteners which are relatively low in tensile attachment strength. As such, relatively large patches of such fibrous fasteners are required to provide adequate attachment to walls. Large patches of fibrous fasteners require large adhesive attachment surfaces which can present significant challenges to their complete removal once they are no longer required.

U.S. Pat. No. 5,974,753 to Hsu discloses a wall panel mounting system including prefabricated T-shaped (in cross section) horizontal supporting strips, L-shaped horizontal supporting strips, L-shaped end-locking strips and decorative panels. The end-locking strips interact with the horizontal strips and the decorative panels, provide an aesthetic appearance to the finished system when assembled on a wall and provide safety by covering the exposed ends of the T-shaped horizontal strips. In use, the wall paneling system may be easily and conveniently installed onto existing walls by a user without professional assistance and may be just as easily and conveniently removed from the wall whenever it is desired to inspect behind the panels, change the decor, or to remove the panels for installation at another location. The '753 patent also discloses a paneling system having panels that can be removed quickly and easily as disclosed in column 9 lines 28-30 of the same. It is further disclosed in column 3 lines 10-11 of the same that hook and loop fasteners are use to secure panels to strips secured to walls. The '753 patent fails to teach a removable panel system that is capable of preventing accidental detachment nor does it teach a safety measure to prevent dropping of a panel upon detaching from a wall. The proposed application for the system disclosed in '753 is for residential use in basements which are typically not exposed to high traffic or use.

U.S. Pat. No. 4,796,397 to Capaul discloses a demountable acoustical panel structure having a honeycomb core, and a thin, dense, sound transmitting glass fiber sheet of uniform thickness adhered to each of the opposed major surfaces of the core. One of the thin sheets advantageously carries segments or patches of a separable fastening means to enable the panel structure to be installed on a supporting surface provided with cooperating segments or patches of a separable fastening means by simply aligning the fastening means. The '397 patent also discloses a paneling system having panels that can be demounted from the support surface without damage to the panels or the support surface as disclosed in column 2 lines 57-58 of the same. It is further disclosed in column 5 lines 3-5 of the same that hook and loop fasteners are use to secure panels to strips secured to walls. The '397 patent also fails to teach a removable panel system that is capable of preventing accidental detachment nor does it teach a safety measure to prevent dropping of a panel upon detaching from a wall.

U.S. Pat. No. 7,805,899 to Montgomery discloses a high impact, moisture resistant, wall panel system and methods for mounting a high impact, moisture resistant wall panel to an existing structure. Patent '899 details a high impact, moisture resistant wall panel includes an inert substrate composed of a high density inorganic material. The substrate is dimensionally stable. There is further provided a laminate composed of a substantially rigid polymeric material and an adhesive for engaging the laminate to the substrate. According to this disclosure, any given panel in the wall system can be removed without prior removal of panels above or around the panel. This is accomplished by leaving an adequate reveal around each panel so the panel can be lifted and removed. The size of the panel clip engaged with the wall support is smaller than the reveal dimension, thereby allowing the removal of individual panels. As such, a force sufficient to overcome the weight of a panel is enough to dislodge the panel if the force is applied in a direction for detaching the panel. Such attachment is not secure especially when used in a high traffic area.

As panels are mounted by engaging fixedly attached panel clips to fixedly attached wall supports, this system is not suitable for mounting tightly placed wall panels of non-rectangular shapes.

Thus, there exists a need for a wall panel mounting system that is removable, highly secured wall panel mounting system that is suitable for a high traffic area.

SUMMARY OF THE INVENTION

The present invention discloses a removable highly secured wall panel mounting system for covering a wall in a high traffic area. A high traffic area is defined herein as elevator lobbies, corridors, bathrooms, lobbies/atriums, entrance ways, vestibules, cafeterias, patient rooms, gymnasiums, swimming pools, locker rooms, lounges, meeting rooms of commercial office buildings, schools, colleges, universities, hospitals, transportation facilities, mall/retail stores, restaurants, hotels, condominiums, sporting complexes and the like. The wall panel mounting system comprises a plurality of joint closures configured to mount one or more wall panels, each wall panel having at least one first attachment portion. The first attachment portion is attached to a portion of the rear face of each wall panel.

In a first embodiment, each joint closure includes an elongated strip and a plurality of flange pairs disposed substantially symmetrically about the longitudinal axis of the strip. The elongated strip has a substantially rectangular cross-sectional profile with two side walls connecting the top wall to the bottom wall. Each flange is substantially an isosceles trapezoid comprising a top surface with a centrally disposed through slot, a weakened base and two inwardly pointing sides extending from each end of the weakened base. The weakened base is connected to one of the two side walls and each flange extends perpendicularly therefrom. A joint closure is adjustably secured to the wall by fastening at least one fastener through the through slot of a flange. Each second attachment portion is attached to a portion of a flange and each first attachment portion is removably attachable to a second attachment portion by a pushing force of less than 10 lbs applied substantially normal to the wall on the front face of the panel to generate a tensile attachment strength to attach the panel to the at least one joint closure. In one embodiment, the tensile attachment strength ranges from about 50 psi to 75 psi of the first attachment portion.

In one embodiment, each joint closure further comprises a substantially rectangular crown centrally disposed on the top wall so as to provide appearance of sophistication to the joint closure or to mask any imperfections of the elongated strip on which it is disposed.

In a second embodiment, each joint closure comprises an elongated strip having a longitudinal axis and a substantially rectangular cross-sectional profile including a top wall, a bottom wall and two side walls connecting the top wall to the bottom wall. At least one plate opening connecting the two side walls and centrally disposed about each pair of flanges is provided. A plurality of pairs of flanges is provided with each pair of flanges disposed substantially symmetrically about the longitudinal axis of the strip. Each flange is substantially an isosceles trapezoid comprising an outer base, a weakened base and two inwardly pointing sides, each extending from each end of the weakened base, wherein the weakened base is connected to a portion of one of the two side walls and each flange extends perpendicularly therefrom. A screw opening is further provided and centrally disposed about each pair of flanges. At least one securing plate is provided. The securing plate is substantially rectangular and includes a centrally disposed aperture and two second attachment portions, each disposed on a lengthwise end of the securing plate. The securing plate is configured to be disposed in the plate opening. Each joint closure is adjustably secured to a wall by fastening at least one fastener through the aperture of the securing plate and the screw opening into the wall such that the joint closure is capable of adjustment with respect to the securing plate.

In a third embodiment, each joint closure comprises an elongated bottom plate having a top surface, a width and two longitudinal edges. Each joint closure further comprises an elongated strip having a longitudinal axis and a substantially rectangular cross-sectional profile including a top wall, a bottom wall and two side walls connecting the top wall to the bottom wall, wherein the elongated strip is centrally disposed atop the top surface of the elongated bottom plate. A screw opening is centrally disposed about the width of the elongated bottom plate. A plate opening connecting the two side walls is centrally disposed about the screw opening. At least one securing plate is provided. The securing plate is substantially rectangular and includes a centrally disposed aperture and two second attachment portions, each disposed on a lengthwise end of the securing plate. The securing plate is configured to be disposed in the plate opening. Each joint closure is adjustably secured to a wall by fastening at least one fastener through the aperture of the securing plate and the screw opening into the wall such that the joint closure is capable of adjustment with respect to the securing plate.

The first attachment portion has an attachment surface and a support surface. The attachment surface of the first attachment portion is constructed from reclosable fasteners and the support surface is coated with adhesive. Similarly, the second attachment portion has an attachment surface and a support surface. The attachment surface of the second attachment portion is constructed from reclosable fasteners and the support surface is coated with adhesive. In one embodiment, the first and second attachment portions are identical. Each first attachment portion is configured to be removably attachable to a second attachment portion by a pushing force of less than 10 lbs applied substantially normal to the wall on the front face of the wall panel to generate a tensile attachment pressure to attach the wall panel to the joint closure.

There is further provided a vacuum lifter having a handle and a vacuum cup. The vacuum cup is operably connected to the handle and configured to be operably attached to a portion of the front face of a wall panel. When a pulling force is applied to the handle in a direction away from the wall panel, the first attachment portion detaches from the second attachment portion, causing the wall panel to be detached from the wall on which the wall panel is mounted.

In another embodiment, an enhanced vacuum lifter is provided. The improved vacuum lifter comprises a handle, a rod receptor pivotably connected to the handle and a vacuum cup. The vacuum cup is operably connected to the handle to form a first line of actuation and a rod having a handle end and an actuating end. In use, the rod is inserted through the receiver to form a second line of actuation, whereby when the wall panel is desired to be removed, the vacuum cup is operably attached to a first portion of the front face of the wall panel and the actuating end of the rod is brought into contacting abutment with a second portion of the front face of the wall panel such that the first line of actuation is placed at an angle of from about 15 to 75 degrees with respect to the second line of actuation. When a force is applied to the handle end of the rod to cause rotation about the actuating end of the rod away from the wall panel, the first attachment portion detaches from the second attachment portion to cause the wall panel to be detached from the wall.

The present wall panel mounting system further comprises at least one first supplementary attachment portion attached to a portion of the rear face of the wall panel, at least one second supplementary attachment portion and at least one intermediate panel support including an elongated strip. The intermediate panel support differs from the joint closure of the first, second or third embodiments in that its elongated strip does not protrude above the top surface of flanges such that a wall panel may be laid flat atop the intermediate panel support in use. The top surface of each flange is substantially flush with the top wall of the elongated strip.

It is a primary object of the present invention to provide a wall panel mounting system that is simple to manufacture, install and remove.

It is another object of the present invention to provide a wall panel mounting system that accommodates non-rectangular wall panels without undue modifications or customizations to the present wall panel mounting system as well as the walls to which the present wall panel mounting system is installed.

It is another object of the present invention to provide a wall panel mounting system that is secure and suitable for use in a high traffic area.

It is another object of the present invention to provide a wall panel mounting system that requires minimal modifications and causes minimal damage to a wall on which the wall panel mounting system is attached.

It is another object of the present invention to provide a wall panel mounting system which requires minimal number of parts for joint closures and provides joint closures which are manually modifiable for field applications.

Whereas there may be many embodiments of the present invention, each embodiment may meet one or more of the foregoing recited objects in any combination. It is not intended that each embodiment will necessarily meet each objective.

Thus, having broadly outlined the more important features of the present invention in order that the detailed description thereof may be better understood, and that the present contribution to the art may be better appreciated, there are, of course, additional features of the present invention that will be described herein and will form a part of the subject matter of the claims appended to this specification.

In this respect, before explaining at least one embodiment of the invention in detail, it is to be understood that the invention is not limited in its application to the details of construction and the arrangements of the components set forth in the following description or illustrated in the drawings. The present invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the conception regarded as the present invention.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
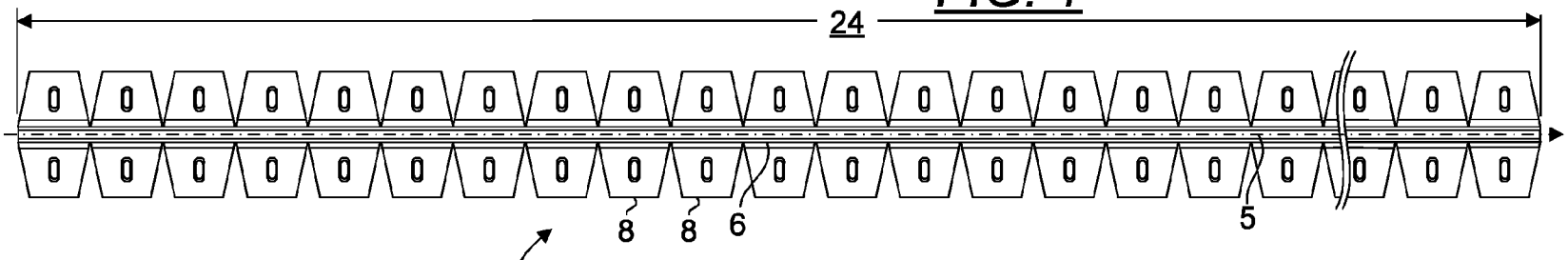
FIG. 1 is a front orthogonal view of a first embodiment of a joint closure.

2—wall
4—joint closure with pairs of flanges straddling its elongated strip
5—longitudinal axis of joint closure
6—elongated strip
7—side wall of elongated strip
8—flange
9—side edge of flange
10—through slot
11—top surface of flange
12—wall panel
14—attachment portion secured to wall panel
15—supplementary attachment portion secured to wall panel
16—attachment portion secured to flange
17—supplementary attachment portion secured to flange
18—fastener
19—enhanced mounting configuration of first embodiment
20—protrusion
22—groove
24—length of elongated strip
25—bottom wall of elongated strip
26—width of elongated strip
27—top wall of elongated strip
28—crown
29—bottom periphery of wall panel
30—width of crown
32—width of flange
34—length of through slot
36—thickness of flange
38—height of strip without crown
40—height of strip including crown
42—weakened base
44—incline connecting top surface of flange to weakened base
46—distance from center of through slot to side wall of strip
48—angle of flange side edge with respect to side wall of strip
50—central axis of through slot
54—inside corner joint closure
56—outside corner joint closure
58—inside corner main flange
60—inside corner secondary flange
62—inside corner bridge
64—outside corner main flange
66—outside corner bridge
68—vacuum lifter
69—longitudinal axis of handle
70—handle
72—rod receptor
74—handle support post
76—suction implement
78—aperture
80—rod
81—handle end of rod
82—intermediate panel support
83—actuating end of rod
84—intermediate panel support strip
86—metal strip
88—nail
90—first line of actuation
92—second line of actuation
94—large washer
95—aperture
96—small washer
97—aperture
98—cored supplementary attachment portion secured to flange
99—surface of large washer that faces away from wall
100—cutout
102—joint closure with unpaired flanges of the first embodiment
104—joint closure with pairs of flanges straddling its elongated strip
106—screw opening
108—length of screw opening
110—width of screw opening
112—plate opening
114—width of plate opening
115—depth of plate opening
116—divider
117—securing plate
118—double securing plate
119—aperture
120—wall stud
122—joint closure with unpaired flanges of the second embodiment
124—attachment portion secured to securing or double securing plate
126—edge of plate opening
128—joint closure with fixed sides
130—elongated bottom plate

132—channel
134—longitudinal edge of elongated bottom plate
136—plate opening configuration for using securing plates
138—plate opening configuration for using double securing plate
140—spacing between two fasteners
142—joint closure with screw and plate openings at regular intervals

PARTICULAR ADVANTAGES OF THE INVENTION

The present invention provides a wall panel mounting system that is simple to install, removable, highly secured and is suitable for a high traffic area. Upon installation, each wall panel is supported by sealable attachments that create sufficient gap behind the wall panel to inhibit or reduce moisture accumulation and mold growth. Installation is simplified by enabling sufficient play between joint closures and wall panels during installation. Therefore, precise mounting (which is often associated with increased labor and costs) of joint closures with respect to wall panels is not required. Each panel may additionally be supported by joint closures that are fastened into the wall at its bottom periphery. As such, requirement for the sealable attachment may be relaxed, thereby reducing the amount of sealable attachment required.

A novel remover is provided to ease removal of panels by reducing the required pulling force. By lowering the amount of pulling force required, the sealable attachment can be made to secure the panels at higher tensile attachment strength, resulting in more secured attachment of the wall panels to a wall. In one embodiment, the required pulling force to separate a panel from its joint closures using the novel remover is less than about 10 lbs. Without the novel remover, the required pulling force ranges from about 30 lbs to 50 lbs.

There are provided joint closure devices which not only provide aesthetic value but also to facilitate installation of wall panels and provide static support to mounted panels.

Upon installation, the joint closures are sufficiently abutted with the wall panels, leaving no hand holds for effective tampering of installed wall panels. A substantially large tensile force is required to detach a wall panel rendering tampering more difficult. In addition, the joint closures provide a consistent and aesthetic appearance. The joint closures are configured to be bendable in a plane parallel to a wall surface. A wall panel therefore need not be rectangular but may comprise curved edges and varying sizes and shapes. Safety protrusions may alternatively be formed as part of the joint closures and configured to be mated to grooves formed in one edge of each panel to prevent wall panels from falling bottom edge first in case they become unattached.

DETAILED DESCRIPTION OF A PREFERRED EMBODIMENT

The present invention is a removable, highly secured wall panel mounting system for wall panels that is suitable for use in high traffic areas. The system comprises a joint closure which eliminates the need for precision mounting of the same by enabling sufficient play during installation between the joint closure and a wall panel, thereby simplifying installation of the wall panel. The system further comprises a sealable attaching means for securely and sealably attaching the wall panel to the joint closure, thereby eliminating the need for precision mounting of the attaching means and simplifying installation of the wall panel.

Figure 3:
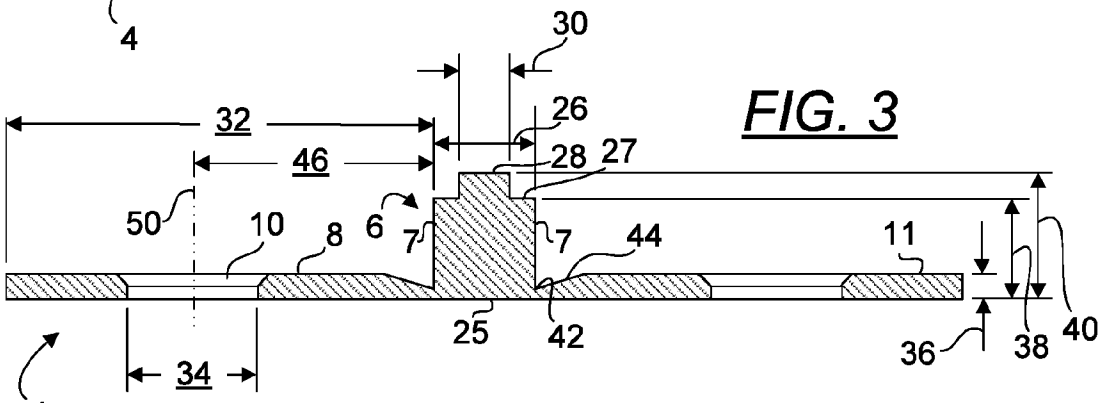
FIG. 3 is a cross-sectional side orthogonal view of the joint closure of FIG. 2 as taken along line AA.
Figure 2:
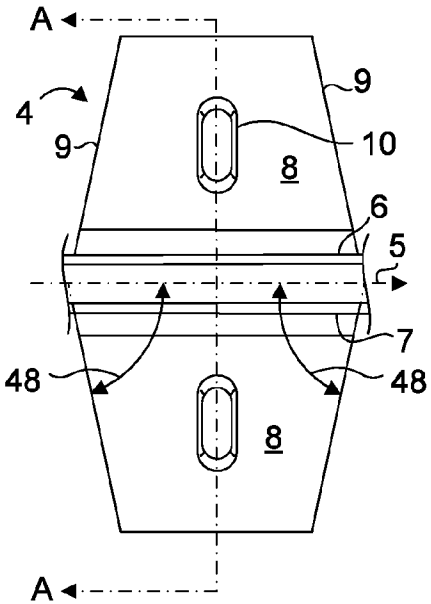
FIG. 2 is a front orthogonal view of a portion of the joint closure of FIG. 1.

FIG. 1 is a front orthogonal view of a joint closure 4. FIG. 2 is a front orthogonal view of a portion of a joint closure 4 of FIG. 1. FIG. 3 is a cross-sectional side orthogonal view of the joint closure of FIG. 2 as taken along line AA. As will be demonstrated in FIGS. 16-24, in the current wall panel mounting system, a plurality of joint closures 4 are used to secure a plurality of wall panels.

Each joint closure 4 includes an elongated strip 6 and a plurality of flange 8 pairs. The elongated strip 6 has a longitudinal axis 5 and a substantially rectangular cross-sectional profile. Two side walls 7 connect the top wall 27 to the bottom wall 25. Each pair of flanges 8 is preferably disposed symmetrically about the longitudinal axis 5.

Each flange 8 is substantially an isosceles trapezoid comprising a top surface having a substantially centrally disposed through slot 10. Two inwardly pointing sides 9 extend from each end of a weakened base 42 at an angle 48 of from about 60 degrees to about 80 degrees from the longitudinal axis 5 to facilitate formation of a maximum joint closure curvature (or minimum radius) of 24 inches in radius while maintaining sufficient flange rigidity. One example of a weakened base 42 is a seam connecting a flange to a side wall of a joint closure having a seam to flange thickness ratio (seam thickness/flange thickness) of less than 1:2. Such a weakened base 42 facilitates removal of a flange when necessary. The top surface tapers at an incline 44 to the weakened base 42.

Each weakened base 42 is connected to one of the two side walls 7 and each flange 8 extends perpendicularly therefrom.

In one embodiment, a rectangular crown 28 is centrally disposed about the longitudinal axis 5 of the elongated strip 6 on the top wall 27 of the elongated strip 6. This crown provides the appearance of sophistication to the joint closure 4 or aesthetically masks any imperfections of the elongated strip 6.

Although not so limited, each joint closure 4 generally comprises a length 24 of from about 8 feet to about 12 feet to accommodate the height of standard walls. During installation, joint closures 4 may be cut to desired length. As will be readily appreciated, where lengths (distances) greater than 12 feet (or the length of any single joint closure) are to be covered, multiple joint closures 4 are adjacently disposed to form a length exceeding that of the length of a single joint closure 4.

The width 26 of each elongated strip 6 preferably ranges from about 3/16 inch to about 1/4 inch. The height 38 of each elongated strip 6 preferably ranges from about 5/16 inch to about 3/4 inch. The height 40 of the elongated strip 6 including the crown 28 preferably ranges from about 7/16 inch to about 7/8 inch. The width 30 of the crown 28 preferably ranges from about 1/16 inch to about 1/8 inch. The width 32 of flange 8 preferably ranges from 1 1/4 inch to 1 3/4 inch. The foregoing dimensions are important in providing visual appeal to an installed wall panel system. The thickness 36 of each flange 8 preferably ranges from about 1/16 inch to about 1/8 inch.

The length 34 of each through slot 10 preferably ranges from about 1/2 inch to about 5/8 inch. The perpendicular distance 46 of the central axis 50 of a through slot 10 to a nearest side wall 7 ranges from about 1/2 inch to 5/8 inch. The through slot 10 is disposed at a distance 46 of from about 1/2 inch to 1 inch.

Figure 4:
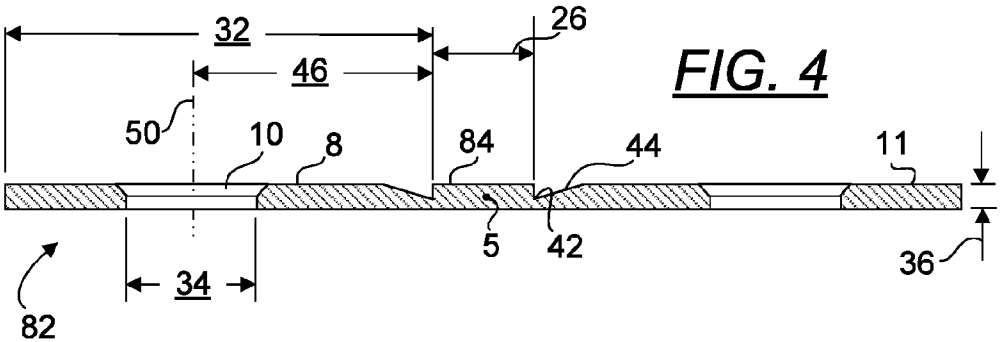
FIG. 4 is a cross-sectional side orthogonal view of an intermediate panel support.

FIG. 4 is a cross-sectional side orthogonal view of an intermediate panel support 82 that is optionally used in some applications. This intermediate panel support 82 is used in between at least two joint closures 4 (e.g., a top and a bottom horizontally disposed joint closure 4) An intermediate panel support 82 provides additional support to a large wall panel and adds supplementary support to the joint closures 4 as demonstrated in FIG. 20. The intermediate panel support 82 differs from the joint closure 4 in that its elongated strip 84 does not protrude above the top surface 11 of flanges 8 such that a wall panel may be laid flat atop the intermediate panel support 82 in use. The top surface 11 of each flange 8 is substantially flush with the top wall of the elongated strip 84.

Figure 5:
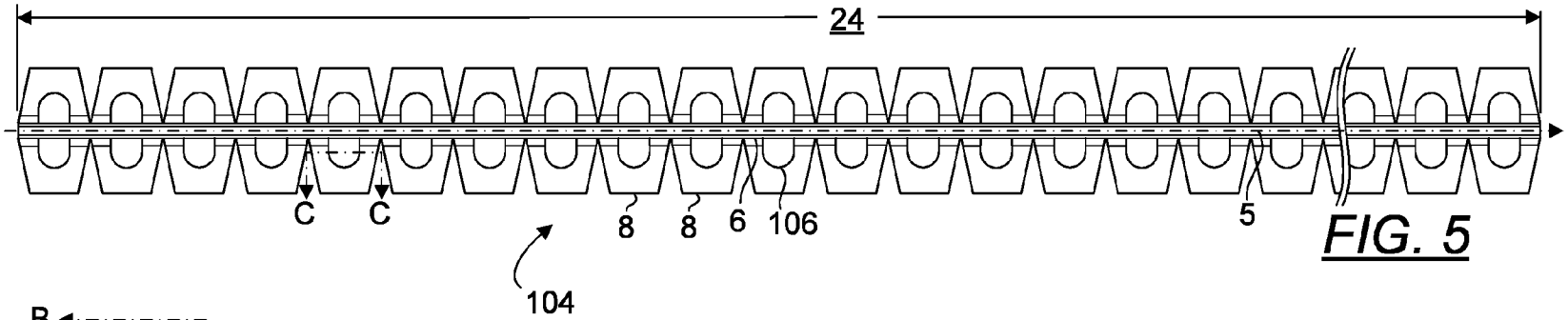
FIG. 5 is a front orthogonal view of a second embodiment of a joint closure.
Figure 7:
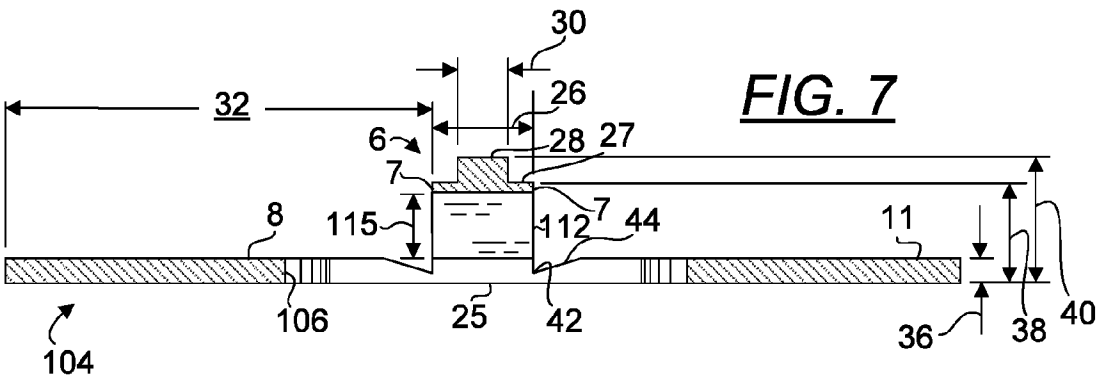
FIG. 7 is a cross-sectional side orthogonal view of the joint closure of FIG. 6 as taken along line BB.
Figure 6:
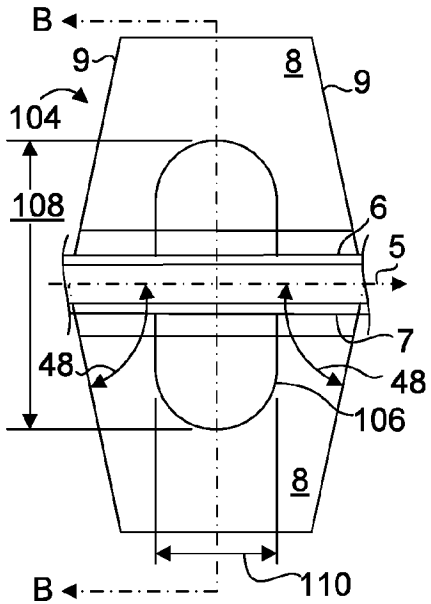
FIG. 6 is a front orthogonal view of a portion of the joint closure of FIG. 5.
Figure 8:
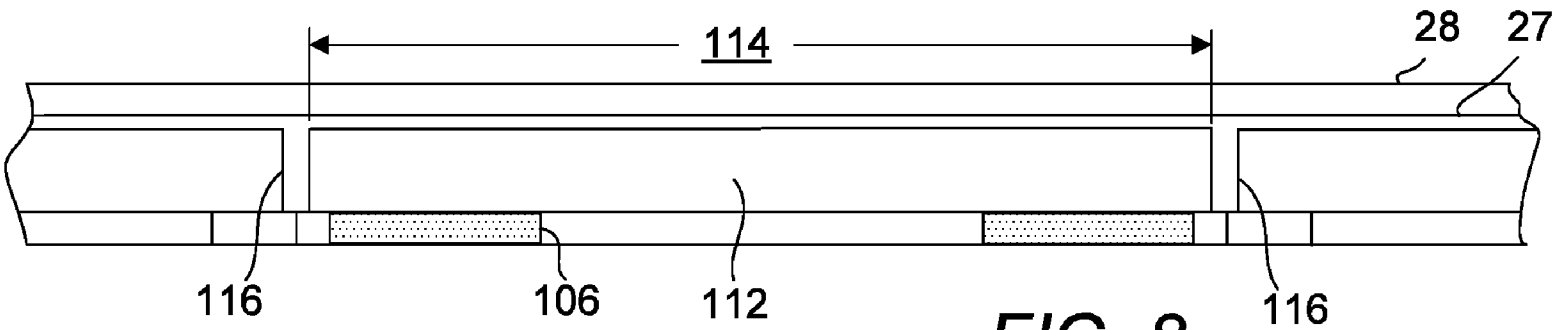
FIG. 8 is a partial cross-sectional top orthogonal view of the joint closure of FIG. 5 as taken along line CC.

FIG. 5 is a front orthogonal view of a second embodiment of a joint closure 104. FIG. 6 is a front orthogonal view of a portion of the joint closure 104 of FIG. 5. FIG. 7 is a cross-sectional side orthogonal view of the joint closure 104 of FIG. 6 as taken along line BB. FIG. 8 is a partial cross-sectional top orthogonal view of the joint closure of FIG. 5 as taken along line CC.

Each joint closure 104 includes an elongated strip 6 and a plurality of flange 8 pairs similar in construction and materials as their respective counterparts of the first embodiment. The elongated strip 6 has a longitudinal axis 5 and a substantially rectangular cross-sectional profile. Two side walls 7 connect the top wall 27 to the bottom wall 25. Each pair of flanges 8 is disposed substantially symmetrically about the longitudinal axis 5.

In this embodiment 104, a plurality of screw openings 106 is further provided. Each screw opening 106 is centrally disposed about each pair of flanges 8. A plurality of plate openings 112 is also provided. Each plate opening 112 connects the two side walls 7 and is centrally disposed about each pair of flanges 8.

Figure 24:
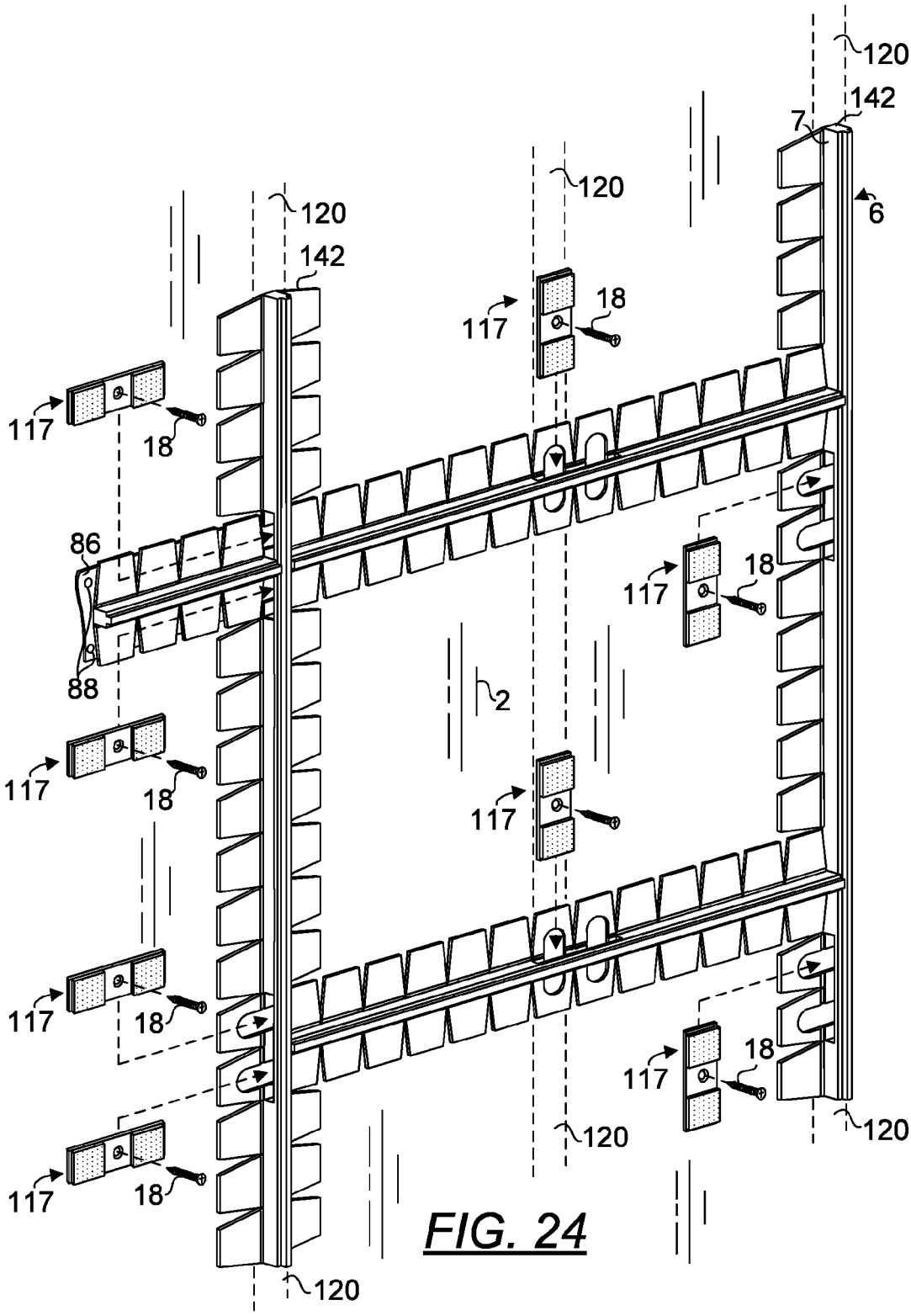
FIG. 24 is a partial front perspective view of a plurality of joint closures of yet another species of the second embodiment depicting a method by which joint closures of the second embodiment are interconnected and secured to a wall.

The Applicant discovered that by providing suitably sized screw opening 106 and plate opening 112, installation of panels can be simplified by removing the need to precisely mount a joint closure with respect to a wall panel. An installer is faced with the challenge of allowing sufficient space for spatial adjustments of the joint closures 104 while properly restraining the joint closures 104 to the wall. In one embodiment, the screw opening 106 measures about 2¼ inches in length 108 and about ¾ inch in width 110. In one embodiment (as shown in FIG. 5), each pair of flanges is coupled with a screw opening 106 and a plate opening 112. In this case, a divider 116 separates two consecutive plate openings 112 to limit the amount of lateral adjustment of a securing plate with respect to its corresponding plate opening. If desired, a divider 116 can be removed to accommodate a larger securing plate. Further, if necessary, screw and plate openings 106, 112 can be provided at a regular interval (as shown in FIG. 24) for instance every 12 inches or every 24 inches.

Figure 9:
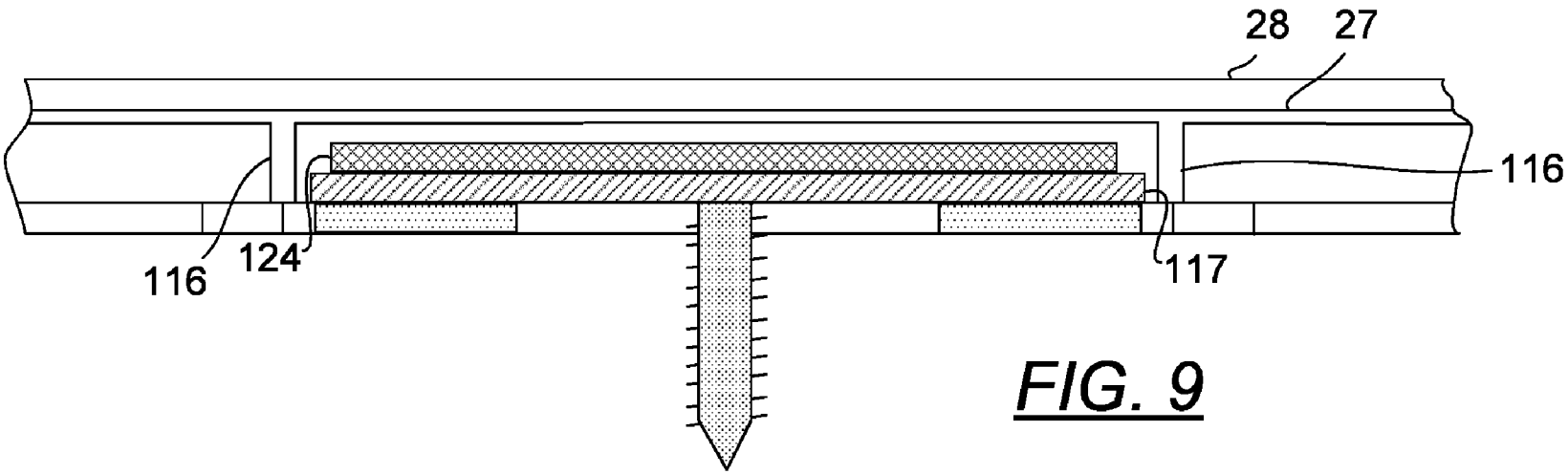
FIG. 9 is a view of FIG. 8 with the addition of a securing plate to depict the relative positioning of a joint closure and the securing plate.
Figure 19:
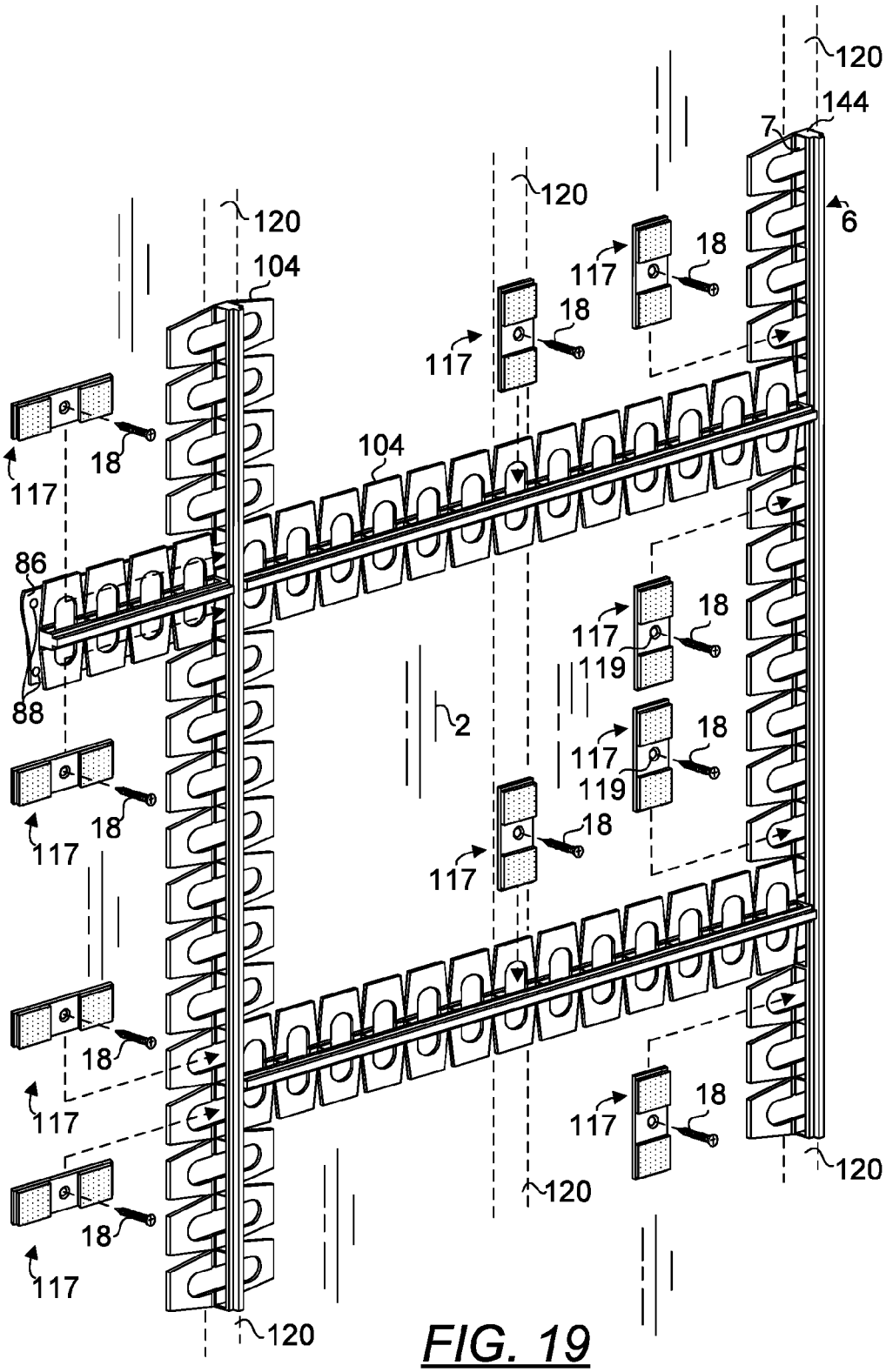
FIG. 19 is a partial front perspective exploded view of a plurality of joint closures of the second embodiment depicting a configuration by which joint closures are prepared to receive wall panels.

FIG. 9 is a view of FIG. 8 with the addition of a securing plate 117 to depict the relative positioning of a joint closure 104 and the securing plate 117. Referring to FIGS. 9 and 19, securing plates 117 are provided for securing joint closures 104 to a wall 2. In one embodiment, a securing plate measures about 1 inch×3 inches×16 to 18 gauge. The securing plate 117 is substantially rectangular and includes a centrally disposed aperture 119 (as shown in FIG. 19) and two second attachment portions 124, each disposed on a lengthwise end of the securing plate 117. The plate opening 112 is configured to enable sufficient space to accommodate the securing plate 117 and allow for spatial adjustment of these two parts. In one embodiment, the depth 115 of the plate opening 112 ranges from about 3⁄16 inch to ¼ inch. The width 114 of the plate opening 112 ranges from about 1¼ inches to 3¼ inches.

Each joint closure 104 is secured to a wall 2 by fastening at least one fastener 18 through the aperture 119 of the securing plate 117 and the screw opening 106 into the wall 2 such that the joint closure 104 is capable of adjustments in the longitudinal and transverse directions of the joint closure with respect to the securing plate 117.

Figure 10:
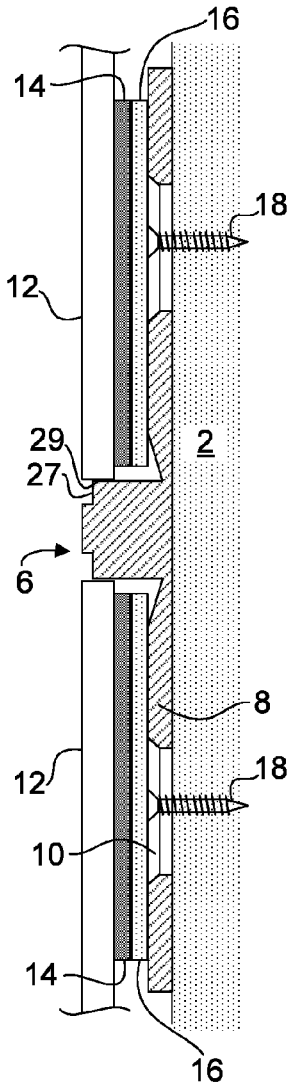
FIG. 10 is a cross-sectional side orthogonal view of a portion of a joint closure of the first embodiment depicting the attachment of two wall panels to it using a first configuration.

FIG. 10 is a cross-sectional side orthogonal view of a portion of a joint closure 4 of the first embodiment depicting the attachment of two wall panels 12 to it. In addition to attachment provided by the attachment portions 14, 15, 16 and 17, a wall panel 12 may be additionally supported by the elongated strip 6 at its bottom edge 29. Each joint closure 4 is secured to a wall 2 by securing a plurality of flanges 8 with fasteners 18.

Figure 11:
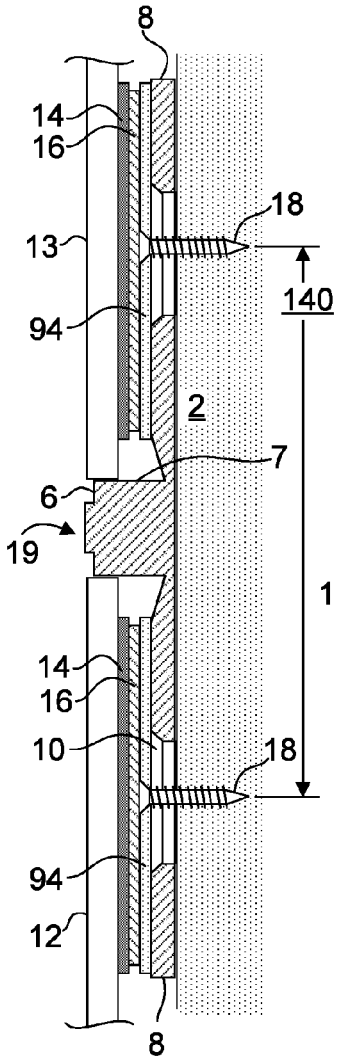
FIG. 11 is a cross-sectional side orthogonal view of a portion of a joint closure of the first embodiment depicting the attachment of two wall panels to it using a second configuration.

FIG. 11 is a cross-sectional side orthogonal view of a portion of a joint closure 4 of the first embodiment depicting the attachment of two wall panels 12 to it using a second configuration. It shall be noted that this configuration enables increased capability for adjustments as compared to the first configuration as a large washer 94 comes in direct contact with the top surface of a flange 8. The capability for adjustments is however still restricted by the periphery of the through slot 10. Preferably the spacing 140 between the fasteners 18 is such that the fasteners 18 may be secured directly onto a wall stud. As demonstrated elsewhere in the document, if the spacing 140 is too large for the width of a stud, only horizontally disposed joint closures will be secured to studs. Typical distances between wall studs might be 12-18 inches, although it is not so limited. As will be appreciated by those skilled in the art, for applications where the supporting wall 2 is sufficiently stiff throughout (such as, for example, a plywood wall), reliance on securing fasteners 18 to a stud is minimized.

Figure 12:
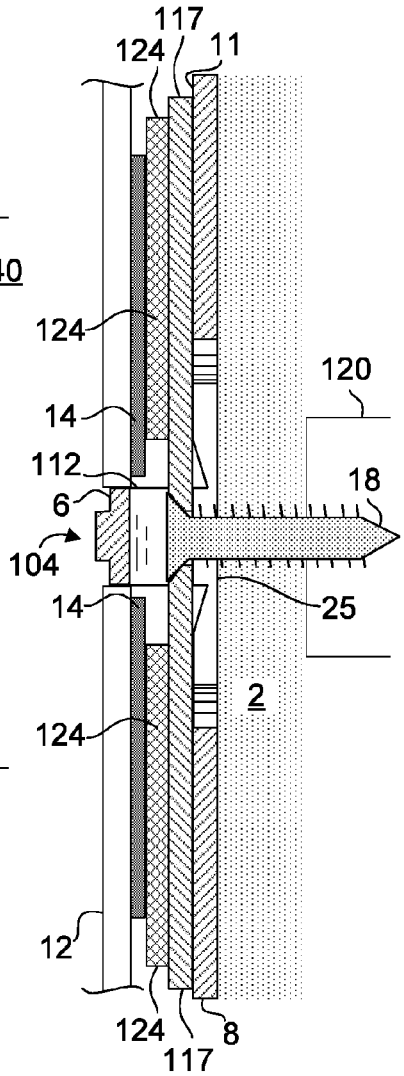
FIG. 12 is a cross-sectional side orthogonal view of FIG. 7 depicting the relative positioning of a joint closure with respect to a securing plate and wall panels.

FIG. 12 is a cross-sectional side orthogonal view of FIG. 7 depicting the relative positioning of a joint closure 104 with respect to a securing plate 117 and wall panels 12. Only one row of fasteners is required to secure the joint closure 104 to a wall 2. Preferably, vertically disposed joint closures 104 are secured in alignment with wall studs 120. During installation, a wall stud 120 is first located. A joint closure 104 is then positioned against a wall 2 prior to sliding a securing plate 117 through a plate opening 112. A fastener 18 is then positioned through the aperture 119 of the securing plate 117 and then through the screw opening 106 prior to fastening the securing plate 117 against the flanges 8. Upon installing a wall panel 12, the joint closure 104 is pushed against the installed wall panel 12. A next wall panel may then be installed on the opposing side of the joint closure 104.

Figure 13:
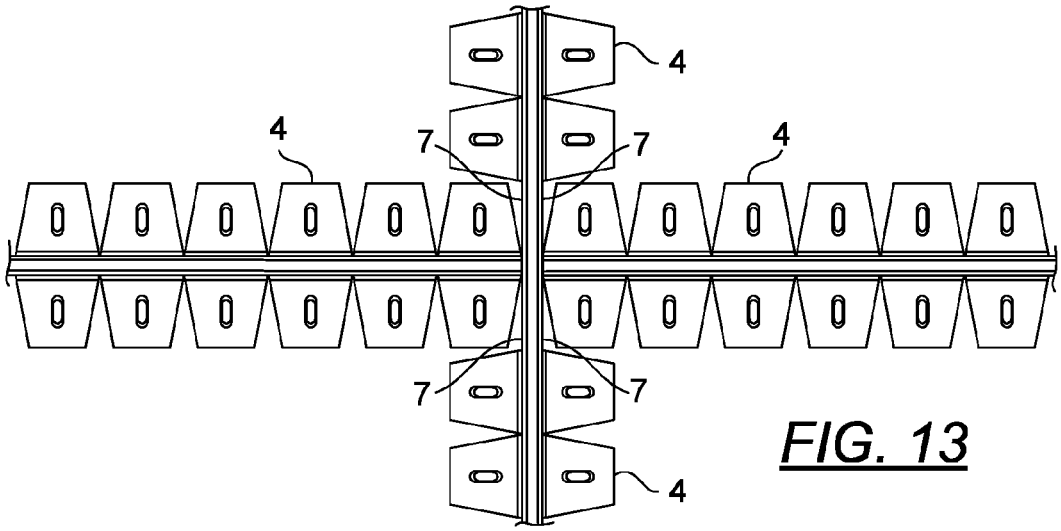
FIG. 13 is a partial front orthogonal view of the interconnection of a vertically disposed joint closure and two horizontally disposed joint closures depicting a method by which joint closures are interconnected.

FIG. 13 is a partial front orthogonal view of the interconnection of a vertically disposed joint closure 4 and two horizontally disposed joint closures 4 depicting a method by which two or more joint closures 4 are interconnected. Two flange 8 pairs are removed from side walls 7 of the vertically disposed joint closure 4 to make way for two horizontally disposed joint closures 4.

Figure 14:
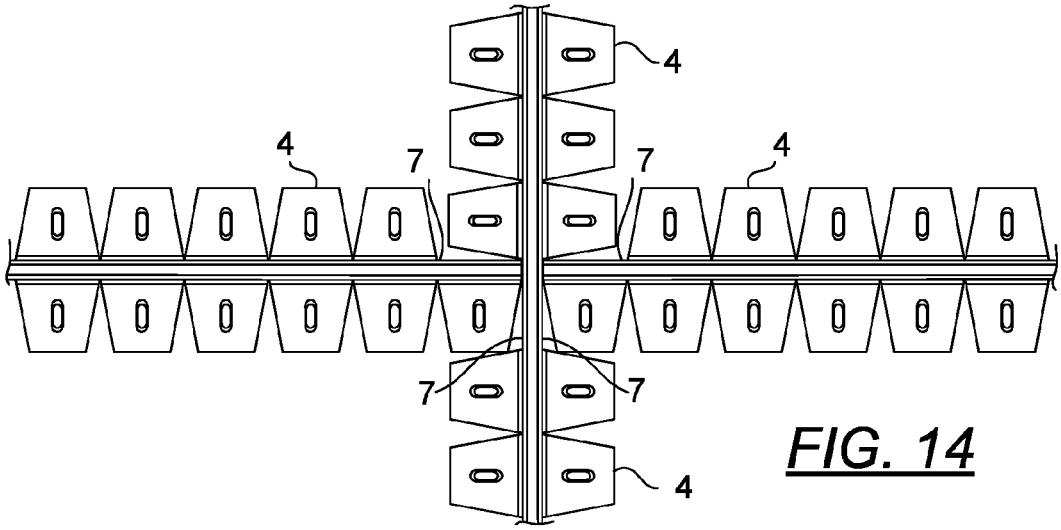
FIG. 14 is a partial front orthogonal view of the interconnection of a vertically disposed joint closure and two horizontally disposed joint closures depicting another method by which joint closures are interconnected.

FIG. 14 is a partial front orthogonal view of the interconnection of a vertically and two horizontally disposed joint closures 4 depicting another method by which two joint closures are interconnected. A pair of flanges 8 is removed from side walls 7 of the vertically disposed joint closure 4 to facilitate space for two horizontally disposed joint closures 4. A flange 8 is removed from a pair of flanges 8 of each of the horizontally disposed joint closures 4 such that the remaining flange 8 of the pair is disposed within an opening left by the removal of the pair of flanges 8 of the vertically disposed joint closure 4. It shall be understood that various other interconnections are possible with the present joint closures 4 by removing appropriate flanges 8 and abutting the elongated strip 6 of one joint closure 4 to the elongated strip 6 of another joint closure 4.

Figure 15:
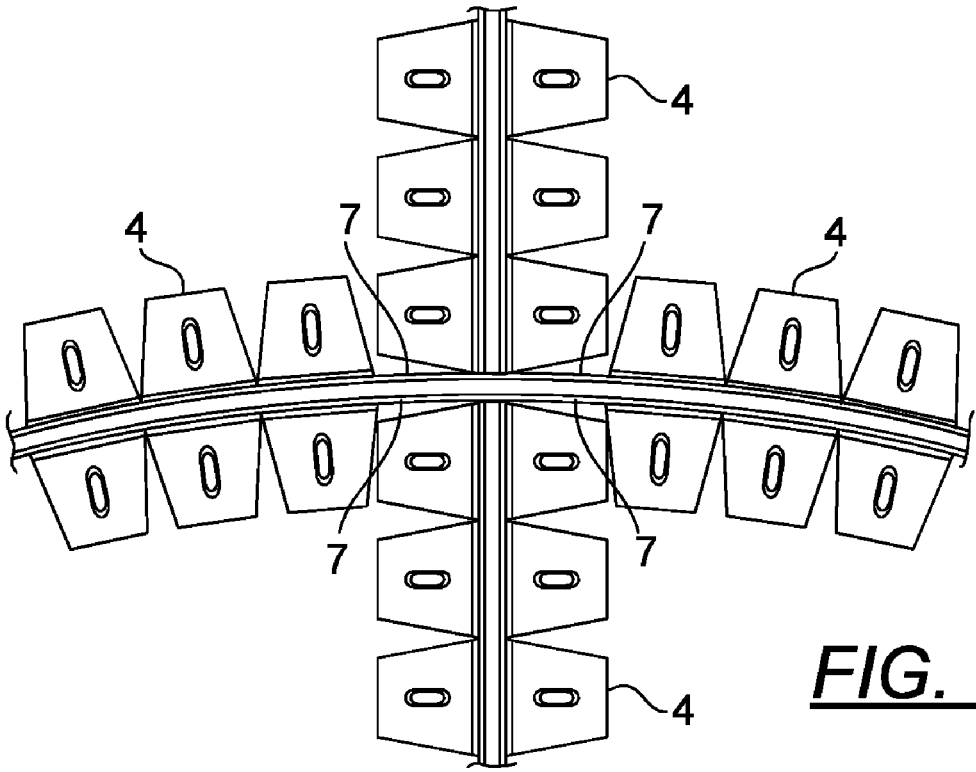
FIG. 15 is a partial front orthogonal view of the interconnection of two vertically disposed joint closures and a horizontally disposed joint closure depicting a method by which a bent joint closure is interconnected with another joint closure.

FIG. 15 is a partial front orthogonal view of the interconnection of two vertically disposed joint closures 4 and a horizontally disposed joint closure 4 depicting a method by which a bent joint closure 4 is interconnected with another joint closure 4. Curved joint closures are required to mount wall panels having curved edges. Two pairs of flanges 8 are removed from side walls 7 of the bent joint closure 4 to facilitate space for two vertically disposed joint closures 4. Each elongated strip 6 cooperates with the inwardly pointing sides of the flanges 8 to accommodate bending while providing sufficient rigidity to the joint closure 4. The end portion of each vertically disposed joint closure 4 is disposed within an opening left by the removal of the two pairs of flanges of the horizontally disposed joint closure 4.

Figure 16:
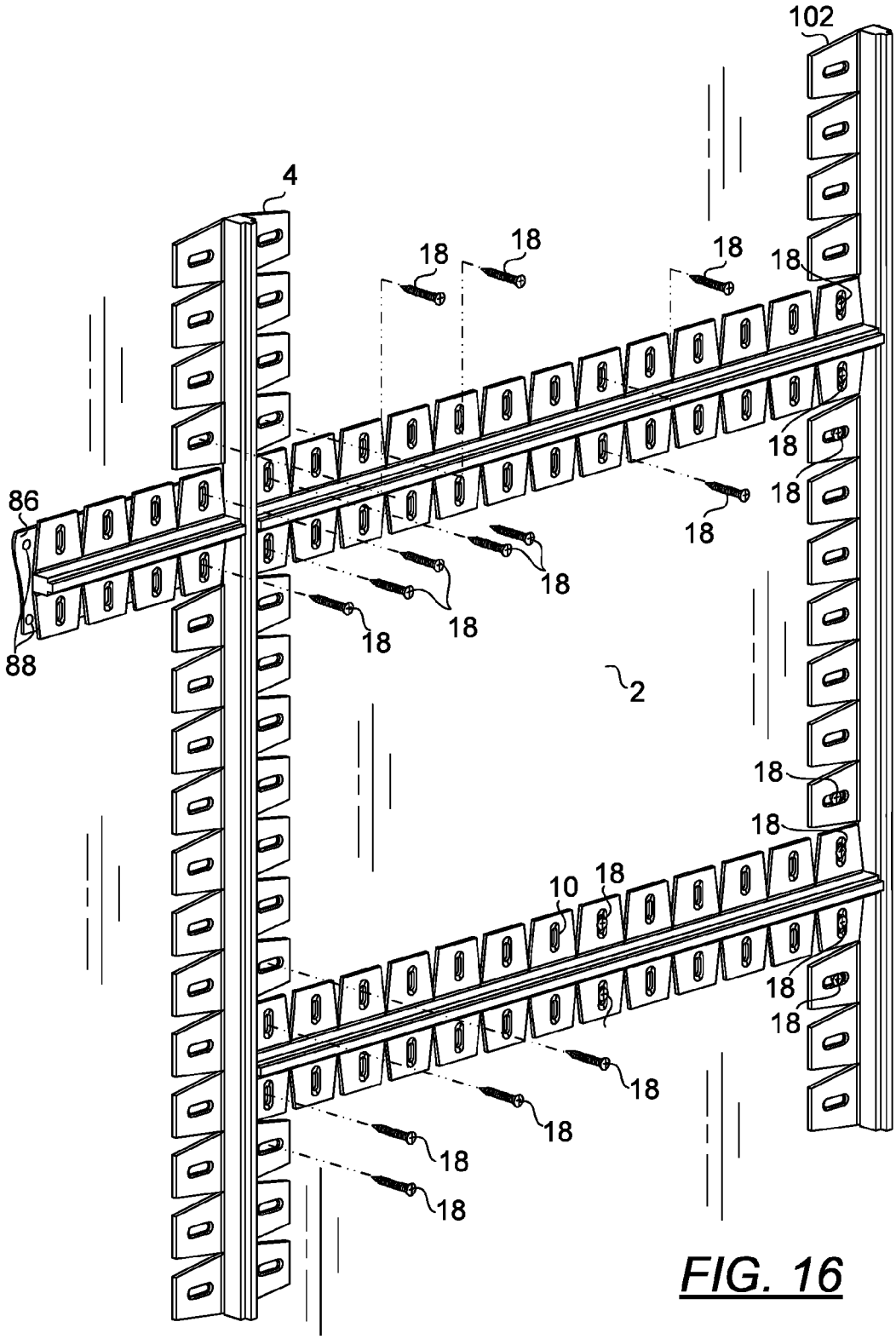
FIG. 16 is a partial front perspective exploded view of a plurality of joint closures depicting a first configuration by which joint closures of the first embodiment are interconnected and secured to a wall.
Figure 17:
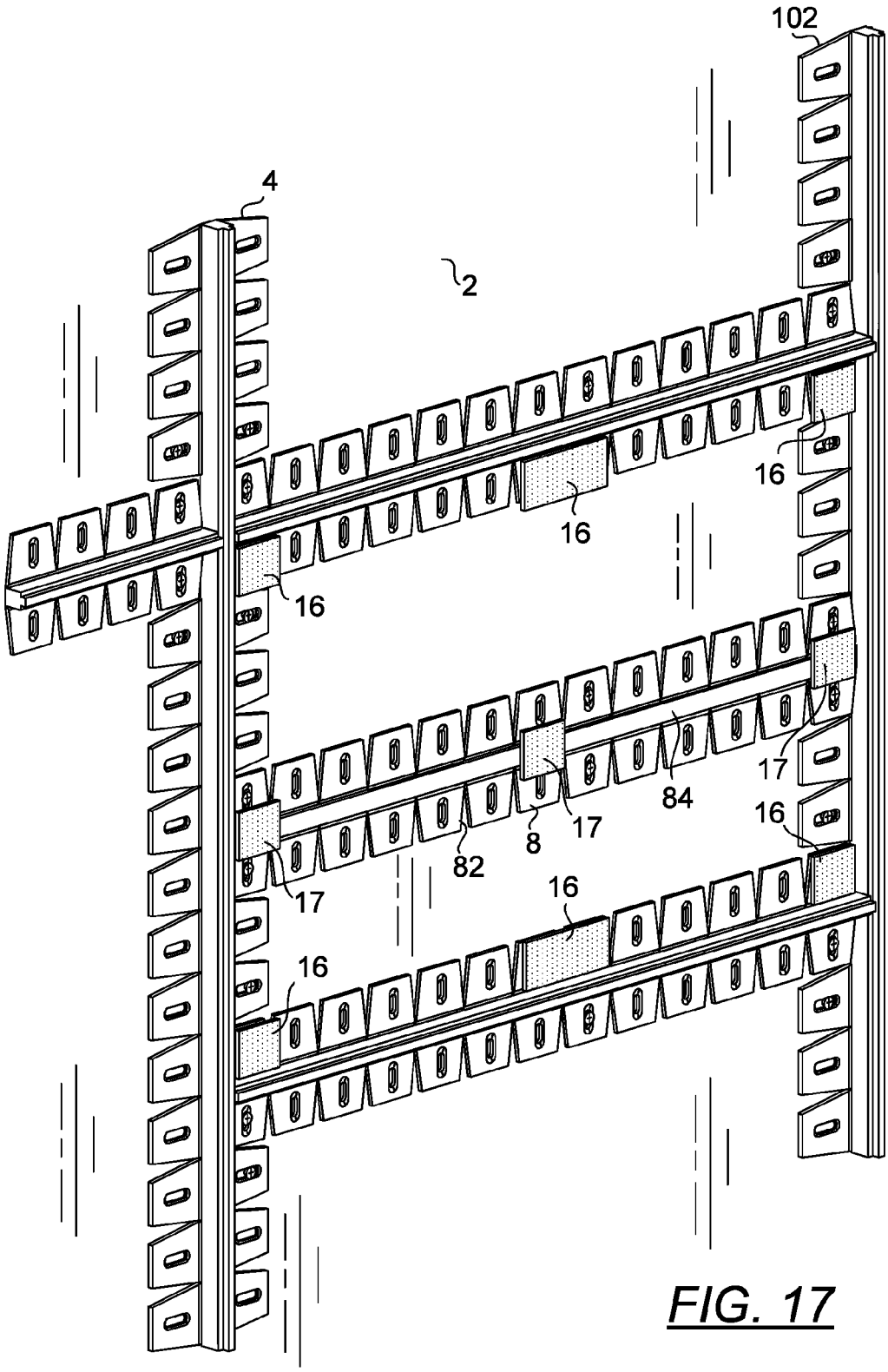
FIG. 17 is a partial front perspective view of a plurality of joint closures depicting a first configuration by which joint closures of the first embodiment are interconnected and secured to a wall.

FIG. 16 is a partial front perspective exploded view of a plurality of joint closures 4, 102 depicting methods by which joint closures 4, 102 are interconnected and secured to a wall 2 and various stages of securement of joint closures 4, 102 to a wall 2. FIG. 17 is a partial front perspective view of a plurality of joint closures depicting a first configuration by which joint closures of the first embodiment are interconnected and secured to a wall. Joint closure 102 comprises flanges disposed only on one side wall 7 of the elongated strip 6 and is particularly suited for installation abutting a border. Each joint closure 4, 102 is adjustably secured to the wall 2 by fastening at least one fastener 18 such as a screw through at least one through slot 10 of at least one flange 8. Joint closures 4, 102 are interconnected and secured to the wall 2 using fasteners 18 to form frames for mounting wall panels 12. Whenever possible, joint closures are preferably secured to wall studs. If necessary, metal strips 86 are first secured by nails to the wall 2 to provide secure backing to mount horizontally disposed joint closures 4. In one embodiment, screws are used as fasteners 18 to fasten joint closures 4, 102 at flanges 8 to the wall 2.

One primary benefit of the present invention lies in its ability to allow sufficient play between a joint closure and a wall panel to relax precise mounting requirement of a joint closure with respect a wall panel. In one example (not shown), attachment portions are installed on horizontal joint closures only. The following steps illustrate an example series of procedures where joint closures 4, 102 of the first embodiment are utilized for mounting wall panels 12 on a wall. A joint closure 102 is first disposed and secured such that its elongated strip abuts the bottom edge of a wall. Wall panels 12 are installed in order of right to left or left to right. In this example, the very first wall panel is installed at a bottom corner of a wall. A joint closure 4 is then disposed and adjustably secured in an intermediate position to result in the joint closure 4 being substantially parallel to the joint closure 102 and at a proximate location to the top edge of a wall panel 12 to be mounted. A plurality of attachment portions 14 are disposed on flanges 8, preferably with each over a screwed down flange 4, 102. Each screwed down flange 8 is capable of adjustment along the lengthwise direction of its through slot 10 but adjustment in a direction perpendicular to the wall is limited. An equal number of matching attachment portions 16 is disposed on the back of a wall panel 12. The very first wall panel 12 is then pushed into place at the bottom corner such that its bottom edge abuts the elongated strip of the installed joint closure 102. The previously installed joint closure 4 may need to be pushed up or down to accommodate the wall panel 12. The previously installed joint closure 4 is then pushed down to its final location until its elongated strip abuts that of the top edge of the wall panel. An additional joint closure 102 may alternatively be used to border a vertical edge of the wall. As used herein, the term "proximate" is defined as a distance within an adjustment distance between the intermediate and final locations. For the first embodiment, this adjustment distance is limited by the length 34 of the through slot 10. A vertical joint closure 4 is then positioned proximate the right or left edge of the installed wall panel 12 and slid into place until its elongated strip abuts the left or right edge of the wall panel 12. The vertical joint closure need not be fastened to the wall. A second wall panel 12 is installed much the same way as the first to the left or right side of the installed first wall panel 12 until the opposing vertical edge of the wall is reached. Upon installing a row of wall panels, the next wall panel 12 is installed from the left or right edge of the wall. The aforementioned series of steps is repeated until the entire wall is covered.

Figure 18:
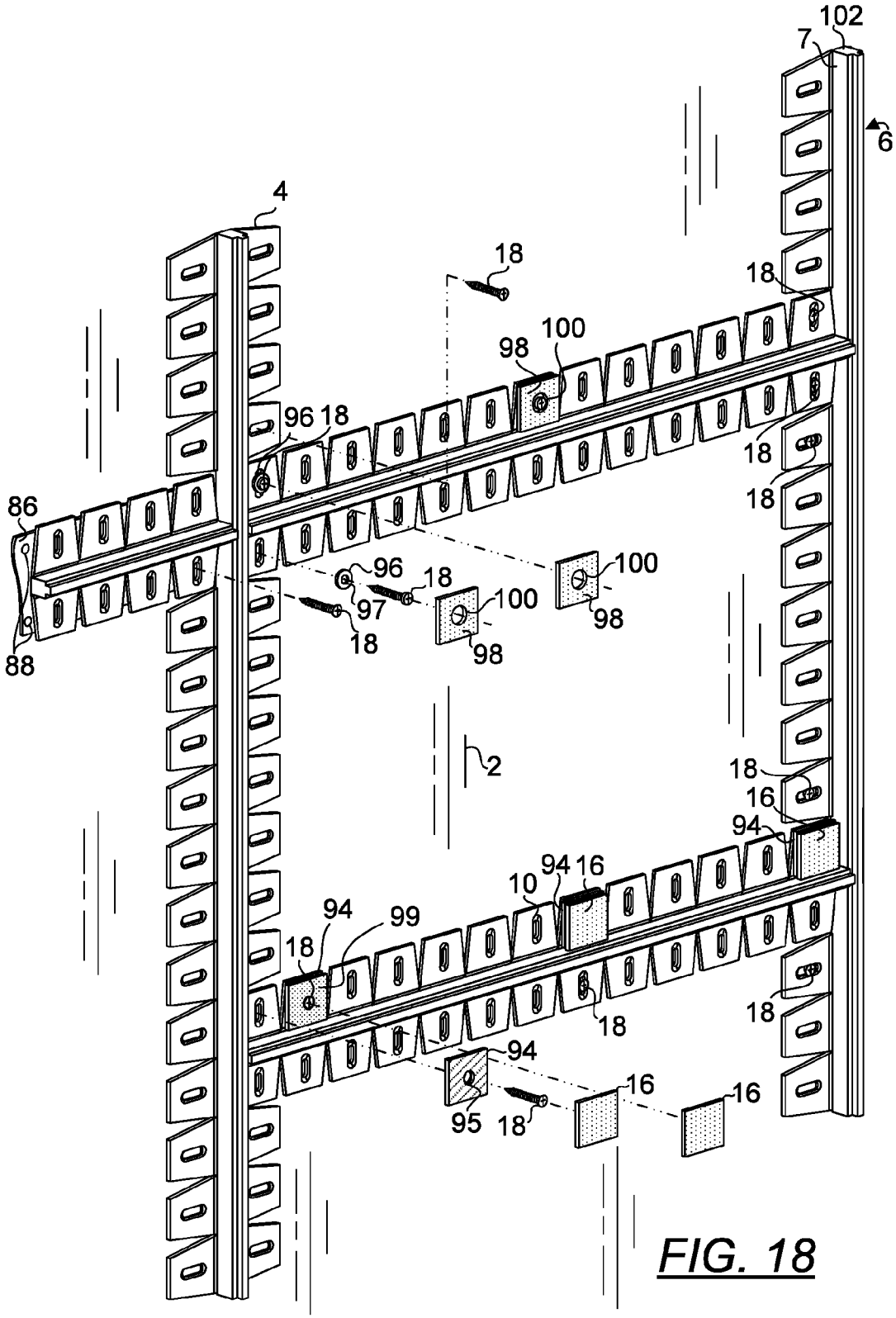
FIG. 18 is a partial front perspective exploded view of a plurality of joint closures depicting a second configuration by which joint closures of the first embodiment are interconnected and secured to a wall.
Figure 21:
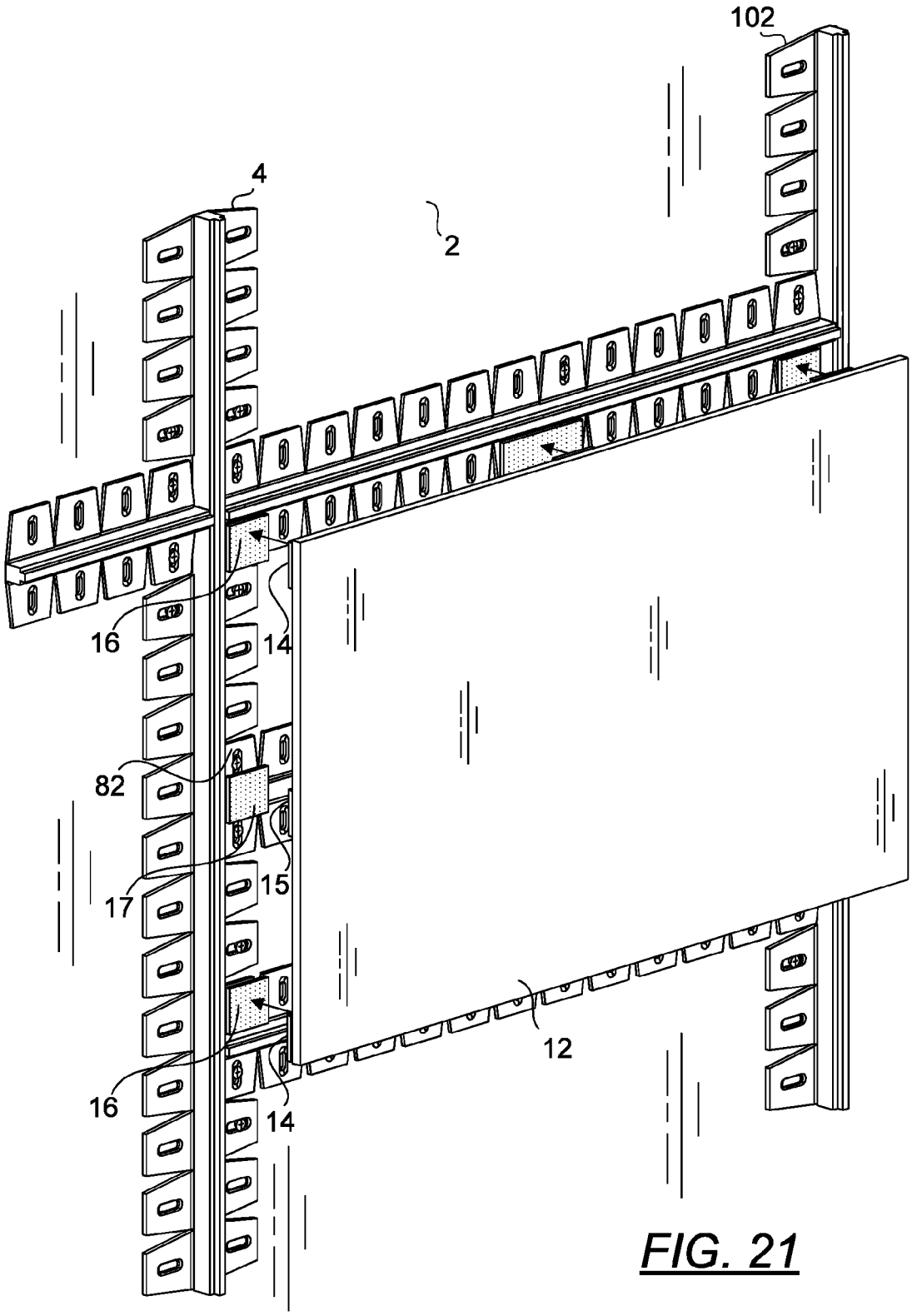
FIG. 21 is a partial front perspective view of a plurality of joint closures and an intermediate panel support depicting a wall panel being aligned for attachment to the prepped joint closures and the intermediate panel support.

FIG. 18 is a partial front perspective exploded view of a plurality of joint closures depicting a configuration by which joint closures of the first embodiment are interconnected and secured to a wall using a second configuration. In the second configuration, a large washer 94 having an aperture 95 is disposed over a flange 8 of a joint closure 4, 102 before the joint closure 4, 102 is fastened to the wall 2 by positioning a screw 18 through the aperture 95 and the through slot 10 and tightening the large washer 94 against the flange 8, leaving sufficient play between the flange 8 and the wall 2 and between the flange 8 and the large washer 94 such that the joint closures 4, 102 are freely adjustable with respect to wall panels 12. Applicant discovered that it is preferable to provide such structural reinforcement for securing the joint closure 4, 102 at any location where a force to remove the panel is directly applied. As shown in FIG. 21, a wall panel 12 having a plurality of first attachment portions 14 is then positioned such that the plurality of first attachments portions 14 are mated to second attachment portions 16 secured to flanges 8. During installation, each second attachment portion 16 is compressed or impacted against a first attachment portion 14 to sufficiently secure the wall panel 12 to the wall 2. Referring back to FIG. 18, upon installation, the surface 99 of the large washer 94 facing away from the wall 2 is preferably substantially flat to provide secure adhesion of the second attachment portion 16 to this surface. Such substantially flat surface is made possible by using a countersunk aperture 95 and a mating countersunk screw 18 head. A second attachment portion 16 is then disposed over the large washer 94 and the screw 18 head to substantially adhere to the surface 99 of the large washer 94. The large washer 94 is preferably constructed from a material sufficiently stiff, such as steel and aluminum to resist flexure when the first attachment portion 14 is separated from the second attachment portion 16.

In yet another configuration shown in FIG. 18, a small washer 96 having an aperture 97 is disposed over a flange 8 of a joint closure 4, 102 before the joint closure 4, 102 is fastened to the wall 2 by positioning a screw 18 through the aperture 97 and the through slot 10 and tightening the small washer 96 against the flange 8, leaving sufficient play between the flange 8 and the wall 2 and between the flange 8 and the small washer 96 such that the joint closures 4, 102 are freely adjustable with respect to wall panels 12. A second attachment portion 16 is then disposed over the small washer 96 and the screw 18 head to substantially adhere to the surface of the flange 8. A cutout 100 is made in a supplementary attachment portion 98 to accommodate protrusion above the surface of the flange 8 caused by the screw 18 head and the small washer 96. The small washer 96 is preferably constructed from a material sufficiently stiff to resist (as previously described with respect to the previous embodiment) flexure when a first attachment portion 14 is separated from its mating second attachment portion 16.

FIG. 19 is a partial front perspective exploded view of a plurality of joint closures of the second embodiment depicting a configuration by which joint closures are prepared to receive wall panels. Each securing plate 117 is disposed such that its fastener 18 is substantially aligned with a wall stud 120. For a joint closure with unpaired flanges 122, such as one used to delineate a border, a securing plate 117 is not inserted within a plate opening 112 but rather it is disposed in a direction substantially parallel to the joint closure 102 while a fastener 18 is positioned through the securing plate 117 and a screw opening 106.

Figure 20:
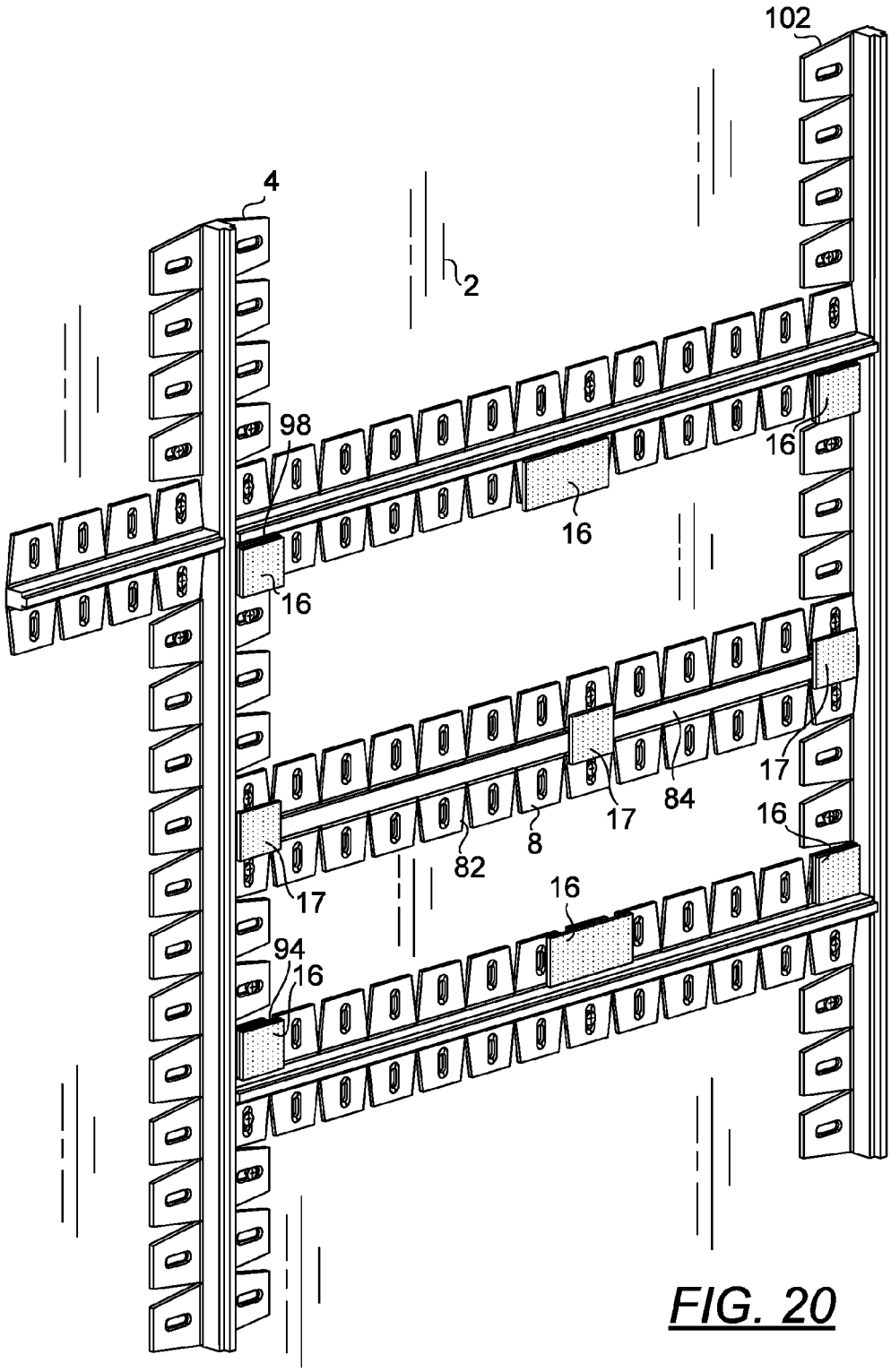
FIG. 20 is a partial front perspective view of a plurality of joint closures of the first embodiment depicting a configuration by which an intermediate panel support is used and a second configuration by which joint closures are prepared to receive wall panel.

FIG. 20 is a partial front perspective view of a plurality of joint closures 4, 102 depicting a method by which an intermediate panel support 82 is used and a second configuration by which joint closures 4, 102 are prepared to receive a wall panel 12. In one embodiment, at least one intermediate panel support 82 is further provided. There is further provided a plurality of second attachment portions 16 and second supplementary attachment portions 17 disposed over top surfaces of flanges 8 of the joint closures 4, 102 and flanges 8 or elongated strip 84 of the intermediate panel support 82, respectively. The intermediate panel is used for the same reason as disclosed elsewhere in this disclosure.

Figure 22:
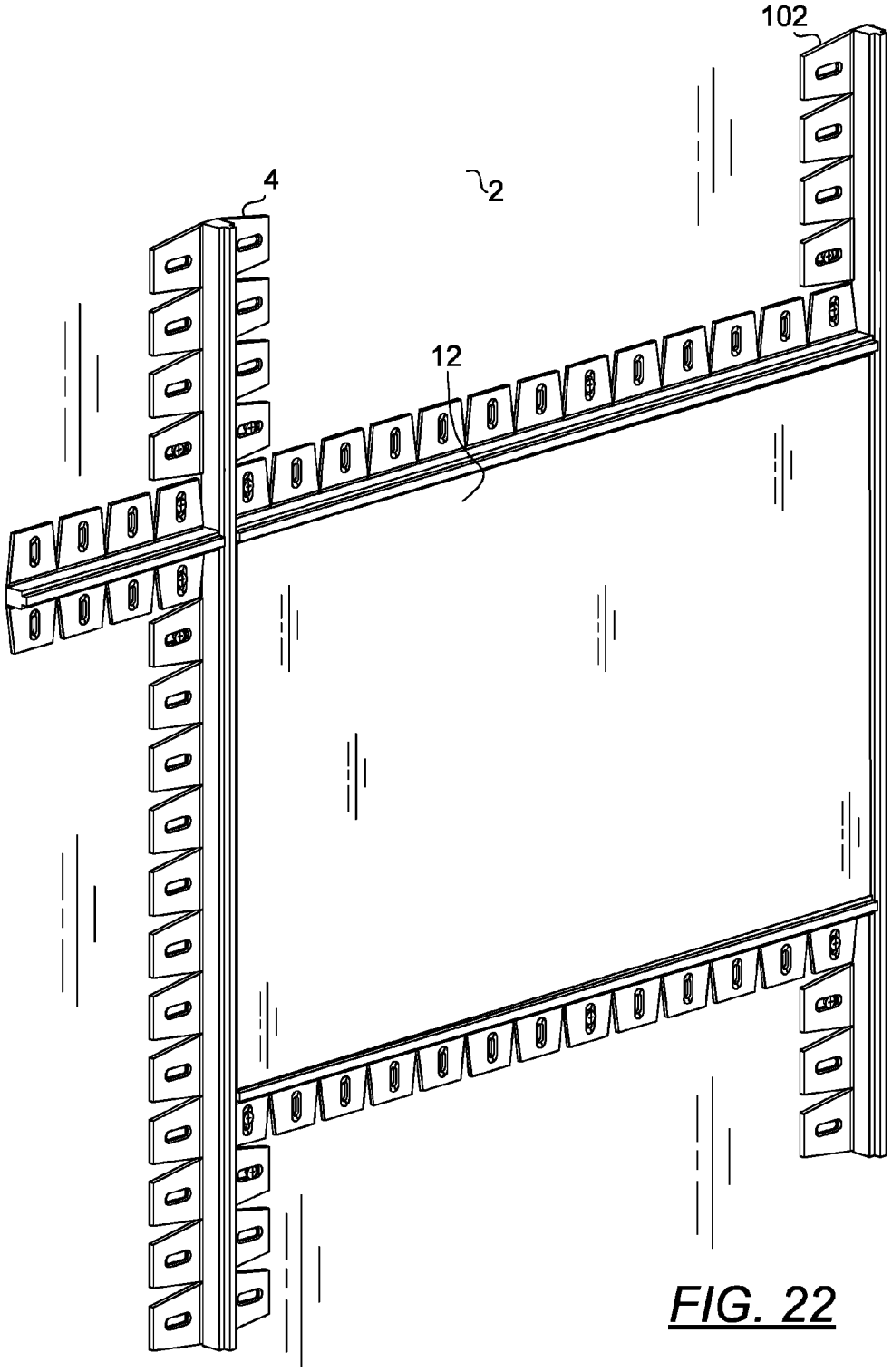
FIG. 22 is a partial front perspective view of a plurality of joint closures of the first embodiment depicting a wall panel having been attached to prepped joint closures.

FIG. 21 is a partial front perspective view of a plurality of joint closures 4, 102 and an intermediate panel support 82 depicting a wall panel 12 being aligned for attachment to the prepped joint closures 4, 102 and the intermediate panel support 82. In order to support wall panels, various flanges 8 of multiple joint closures 4, 102 have been removed so that the joint closures 4, 102 may be assembled and secured in a grid format. FIG. 22 is a partial front perspective view of a plurality of joint closures 4, 102 of the first embodiment depicting a wall panel 12 having been attached to prepped joint closures 4, 102. A plurality of first attachment portions 14 and first supplementary attachment portions 15 are attached to a portion of the rear face of the wall panel 12 so as to be mated with the second attachment portions 16 and second supplementary attachment portions 17, respectively. Each first attachment portion 14 is configured to be removably attachable to the a second attachment portion 16 by a pushing force of less than 10 lbs applied substantially normal (perpendicular) to the wall 2 on the front face of the wall panel 12 to generate a tensile attachment strength to attach the wall panel 12 to the joint closures 4, 102. In one embodiment, the tensile attachment strength ranges from about 50 psi to 75 psi. In a preferred embodiment, the first, second, first supplementary and second supplementary attachment portions are made of the same materials. Each attachment portion comprises an attachment surface and a support surface. An exemplary attachment surface is 3M Dual Lock Reclosable Fasteners SJ3550 having continuous strips of polyolefin stems with a mushroom shaped top protruding up from the support surface. An exemplary support surface is 3M VHB tape capable of withstanding temperatures of 200 degrees Fahrenheit for 10,000 minutes while remaining intact.

Figure 23:
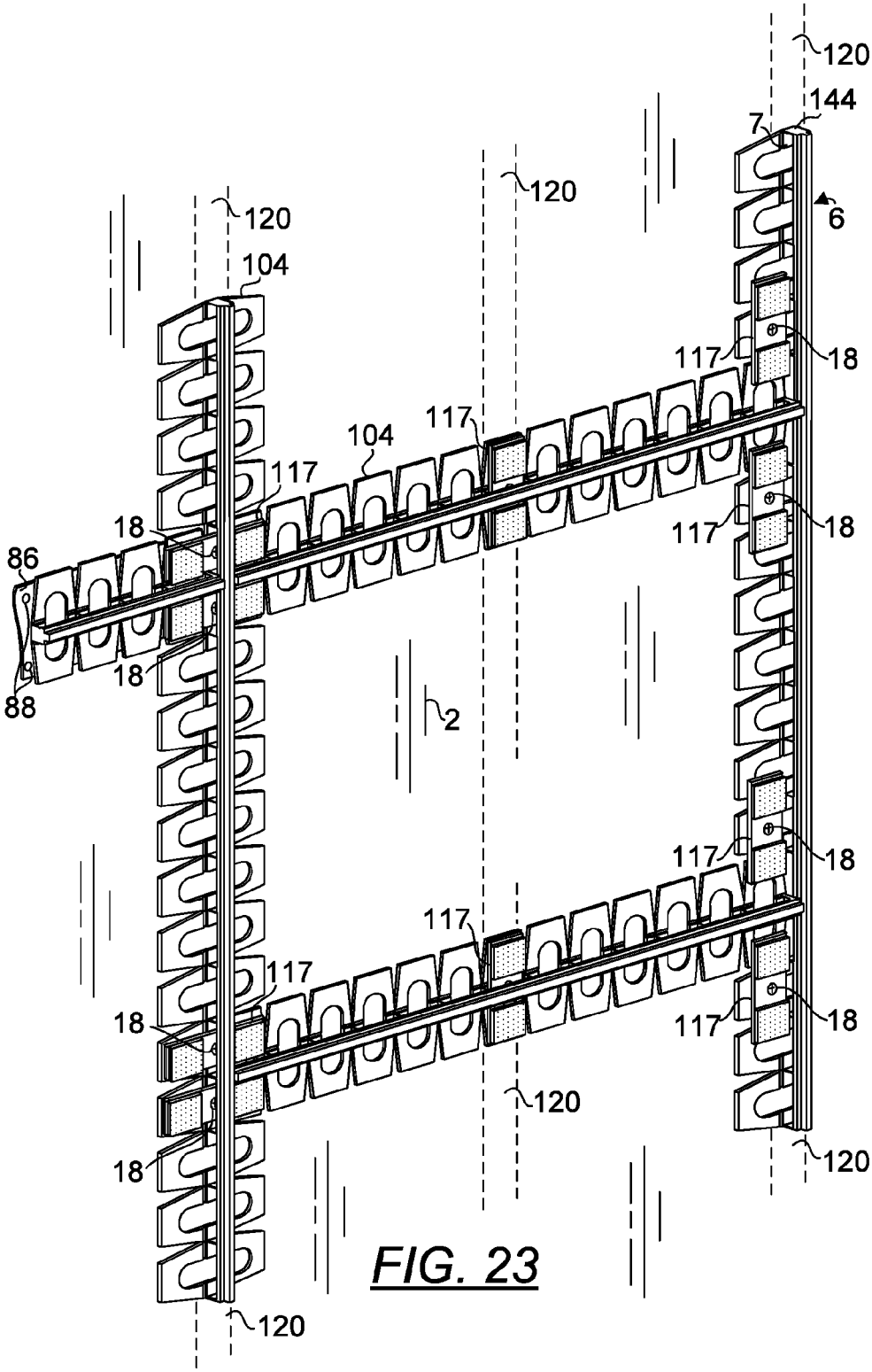
FIG. 23 is a partial front perspective view of a plurality of joint closures of a second embodiment depicting installed securing plates.

FIG. 23 is a partial front perspective view of a plurality of joint closures of the second embodiment depicting installed securing plates 117. FIG. 24 is a partial front perspective view of a plurality of joint closures 142 of yet another species of the second embodiment depicting a method by which joint closures of the second embodiment are interconnected and secured to a wall 2. Note that the plate and screw openings 112, 106 are disposed at an interval and not on every pair of flanges 8.

Figure 25:
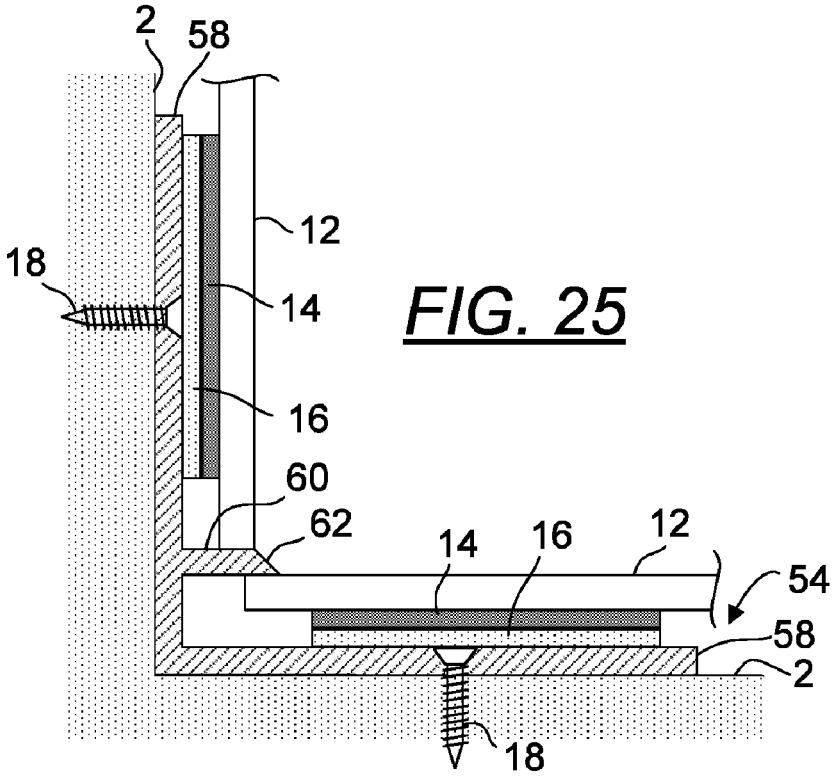
FIG. 25 is a cross-sectional side orthogonal view of an inside corner joint closure depicting a method by which it interconnects two wall panels and attaches to an inside corner formed by two walls.

FIG. 25 is a cross-sectional side orthogonal view of an inside corner joint closure 54 depicting a method by which it interconnects two perpendicularly disposed wall panels 12 and attaches to an inside corner formed by two walls 2. The inside corner joint closure 54 comprises two elongated main flanges 58 formed at a right angle to one another and a secondary flange 60 disposed parallel to a first one of the two main flanges 58 but perpendicular to the second one of the two main flanges 58. The secondary flange 60 is offset a distance sufficient to accommodate a wall panel 12 and its appropriate attachment portions 14, 16 from the seam where the two elongated main flanges 58 meet. The secondary flange 60 further comprises a bridge 62 which provides a transition angle from a wall panel 12 to its adjacent and perpendicularly disposed wall panel 12. Each inside corner joint closure 54 is secured to a corner formed by two walls 2 by securing the two main flanges 58 with fasteners 18.

Figure 26:
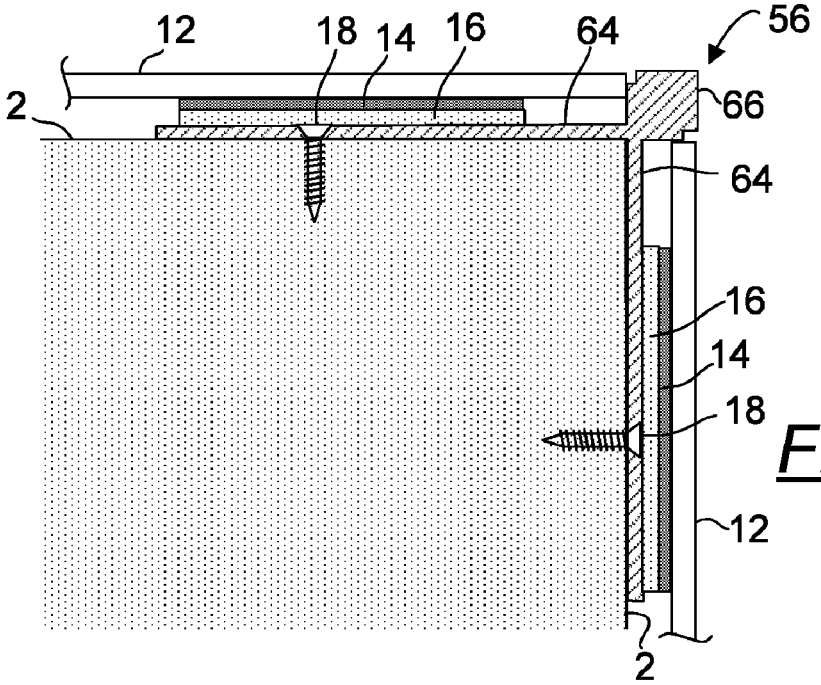
FIG. 26 is a cross-sectional side orthogonal view of an outside corner joint closure depicting a method by which it interconnects two wall panels and attaches to an outside corner formed by two walls.

FIG. 26 is a cross-sectional side orthogonal view of an outside corner joint closure 56 depicting a method by which it interconnects two wall panels 12 and attaches to an outside corner formed by two walls 2. The outside corner joint closure 56 comprises two elongated main flanges 64 formed at a right angle to one another and culminate in a bridge 66. The bridge 66 is an elongated strip having a substantially square profile having four sides. When installed over an outside corner formed from two walls 2, the lateral edge of a wall panel 12 is disposed in contacting abutment with one side surface of the bridge 66. Each outside corner joint closure 54 is secured to a corner formed by two walls 2 by securing the two main flanges 58 with fasteners 18.

Figure 27:
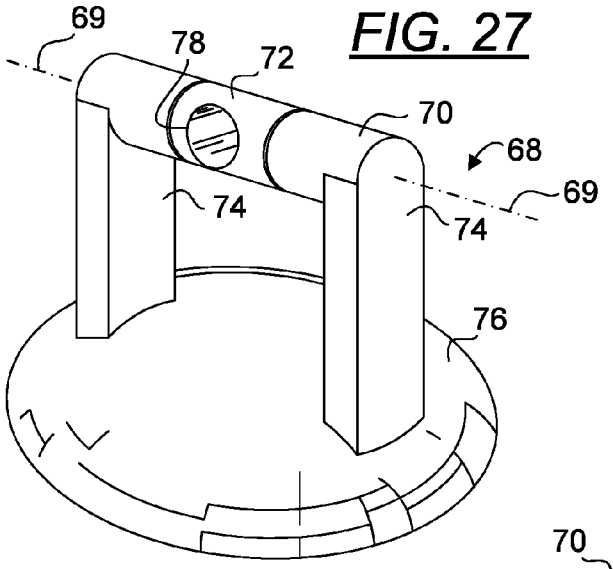
FIG. 27 is a top front perspective view of a vacuum lifter.
Figure 28:
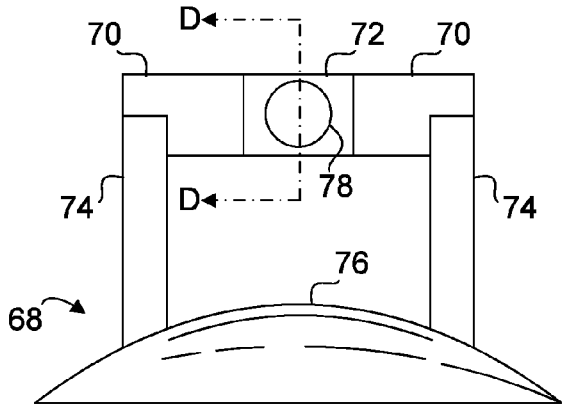
FIG. 28 is a front orthogonal view of a vacuum lifter.
Figure 29:
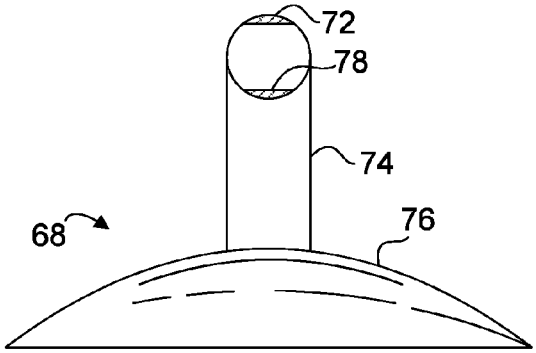
FIG. 29 is a partial side orthogonal view of a vacuum lifter having a rod receptor revealing an aperture configured for rod insertion for leverage.

Damaged or obsolete wall panels may need to be periodically removed. FIGS. 27 and 28 are front perspective and front orthogonal views respectively of a vacuum lifter 68 used to remove an installed wall panel according to the present invention. FIG. 29 is a partial side orthogonal view of a vacuum lifter 68 of FIG. 28 as taken along line DD. The vacuum lifter 68 comprises a rod receptor 72 revealing an aperture 78 configured for rod insertion for leverage. The vacuum lifter 68 comprises a handle 70, two support posts 74 for supporting the handle 70 and a suction implement 76. In one embodiment, the suction implement 76 is a vacuum cup. Reference is made to a vacuum lifting device of U.S. Pat. No. 3,005,652 to Helm for an exemplary suction implement, which disclosure is incorporated by reference in its entirety. A rod receptor 72 is preferably centrally disposed along the handle 70, rotatably mounted about the longitudinal axis 69 of the handle 70. The rod receptor 72 includes an aperture 78 configured to receive a rod for leverage. The suction implement 76 is operably connected to the handle 70 and configured to be operably attached to a portion of the front face of a wall panel 12 to be removed. A pulling force applied in a direction away from the wall panel 12 causes the wall panel 12 to be detached.

Figure 30:
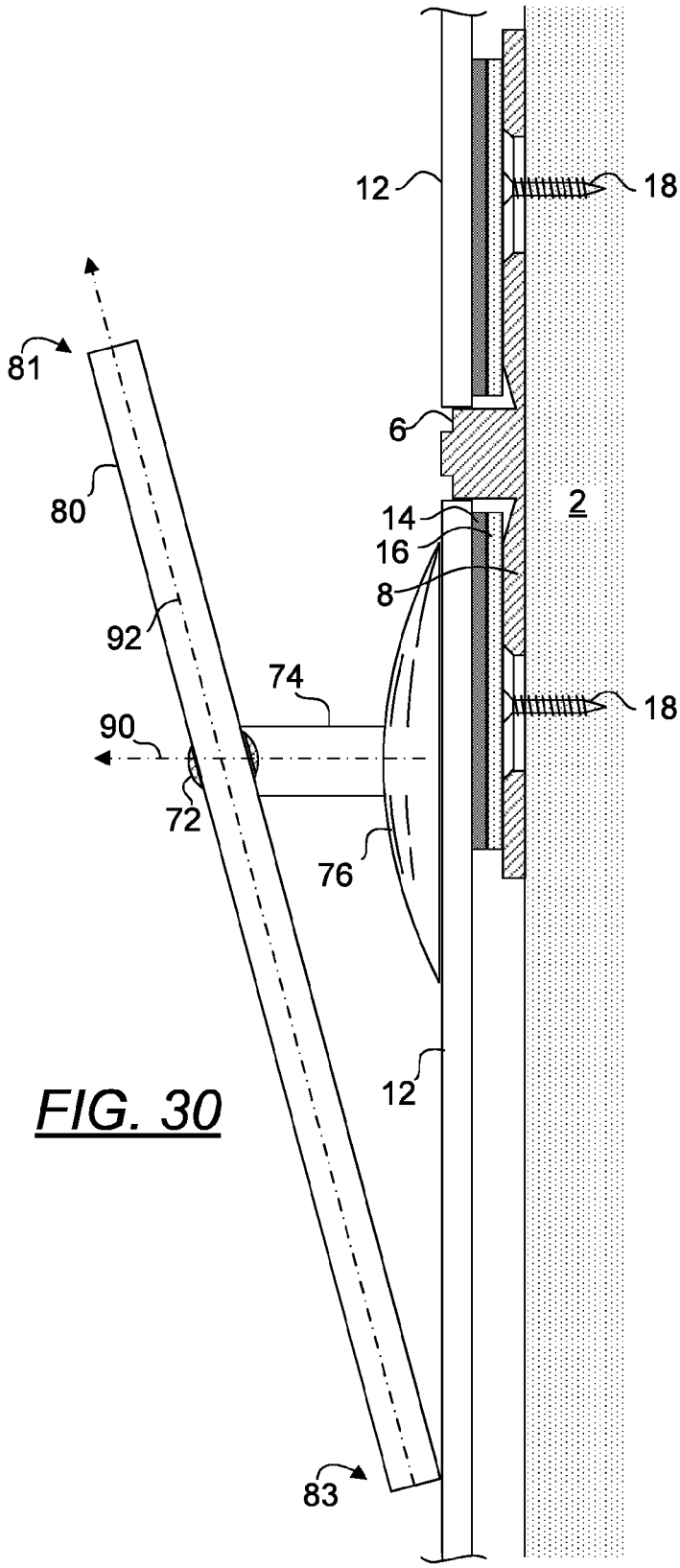
FIG. 30 is a partial side orthogonal view of a vacuum lifter in use.

FIG. 30 is a partial side orthogonal view of the vacuum lifter 68 of FIGS. 27, 28 and 29 in use in conjunction with a rod to reduce the amount of pulling force required to remove a wall panel 12. The suction implement 76 is operably connected to the handle 70 to form a first line of actuation 90. A rod 80 having a handle end 81 and an actuating end 83 is inserted through the aperture 78 of the rod receptor 72 to form a second line of actuation 92. In use, the suction implement 76 is operably attached to a first portion of the front face of the wall panel to be removed and the actuating end 83 of the rod is brought into contacting abutment with a second portion of the front face of the wall panel 12 to be removed such that the first line of actuation 90 is placed at an angle of from about 15 to 75 degrees with respect to the second line of actuation. When a force is applied to the handle end 81 of the rod 80 to cause rotation about the actuating end 83 of the rod 80 and in a direction away from the wall panel 12 to be removed, at least one first attachment portion 14 detaches from its corresponding second attachment portion 16 to cause the wall panel 12 to be detached from the wall 2. In one embodiment, the suction implement 76 is a vacuum cup.

Figure 31:
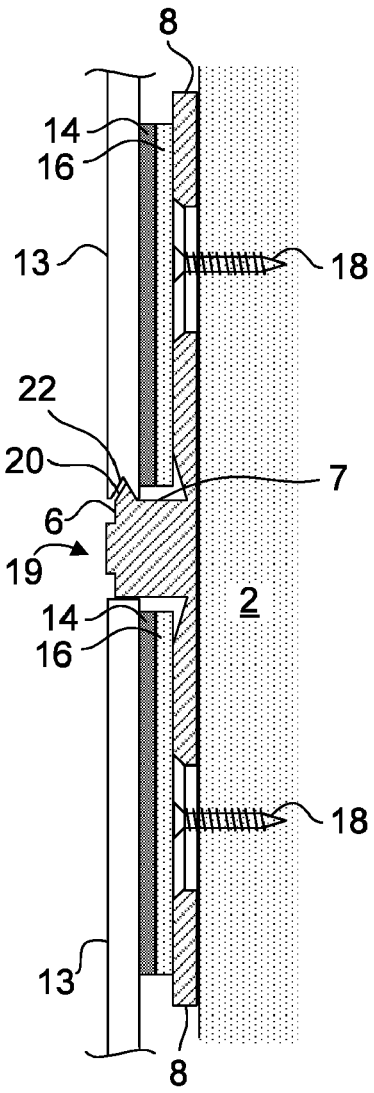
FIG. 31 is a cross-sectional front orthogonal view of a portion of an enhanced joint closure of the first embodiment depicting the use of a retaining feature for a detached wall panel.

FIG. 31 is a cross-sectional front orthogonal view of a portion of an enhanced joint closure 19 of the first embodiment depicting the use of a retaining feature for a detached wall panel 13. The enhanced joint closure comprises a protrusion 20 extending from a side wall 7 of an elongated strip 6 and runs the entire length of the elongated strip 6. In use, the elongated strip 6 is mounted with the side wall 7 having the protrusion 20 facing upwards. In this embodiment, a mating groove 22 running the entire bottom edge of each wall panel 13 is provided such that each protrusion 20 is received in each correspondingly disposed groove 22. Such retaining feature reduces the tendency of a wall panel 13 from falling off the wall either due to accidental detachment of the wall panel 13 or during removal of the wall panel 13 using the previously described vacuum lifter 68. In another embodiment not shown, at least one through hole is disposed on each wall panel-supporting portion of a horizontally disposed elongated strip 6. The through hole connects two side walls 7 wherein a set screw is operably disposed. A mating aperture is provided on the bottom edge of the wall panel configured to be supported on top of the elongated strip. In use, the set screw is driven into the aperture to prevent the wall panel from falling off a wall to which it is attached.

Figure 32:
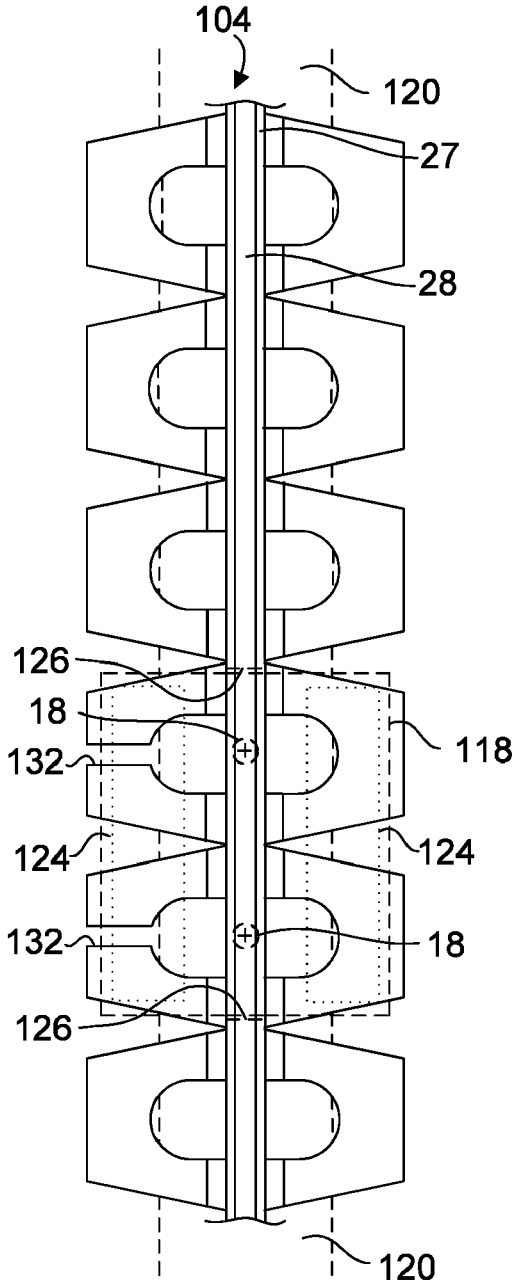
FIG. 32 is a transparent front orthogonal view of an alternate securing plate in use with a joint closure of the second embodiment.

FIG. 32 is a transparent front orthogonal view of an alternate securing plate 118 in use with a joint closure 104 of the second embodiment. FIG. 32 depicts several features not disclosed elsewhere herein. In one embodiment, a double securing plate 118 measuring about 3 inches×3 inches×16 to 18 gauge is used. A channel 132 is provided to facilitate mounting of a joint closure 104. During installation, a securing plate 117 or a double securing plate 118 may be initially positioned and secured to a wall stud 120 without first incorporating the joint closure 104 with the wall stud 120. A template may first be used to aid in locating the double securing plate 118 along the wall stud 120. Such template facilitates marking of locations for attaching securing plates 118 at regular intervals along the wall stud 120. Once the double securing plate 118 has been installed, a joint closure 104 is then aligned such that the plate opening 112 and fasteners 18 are substantially positioned in sliding relationship with the double securing plate 118 and the channels 132, respectively. The joint closure 104 is then slid towards the installed double securing plate 118 until the fasteners 18 come within their respective screw openings 106. As the double securing plate 118 is not positively locked against the joint closure 104, the joint closure 104 may be spatially adjusted in a plane that is coplanar to the wall to which the joint closure 104 is mounted. Ease of installation is therefore afforded since precision mounting of the joint closure 104 is not required. Upon installation of the joint closure 104 and their respective wall panels (not shown), only the top wall 27 of the elongated strip and the crown 28 would be revealed.

Figure 33:
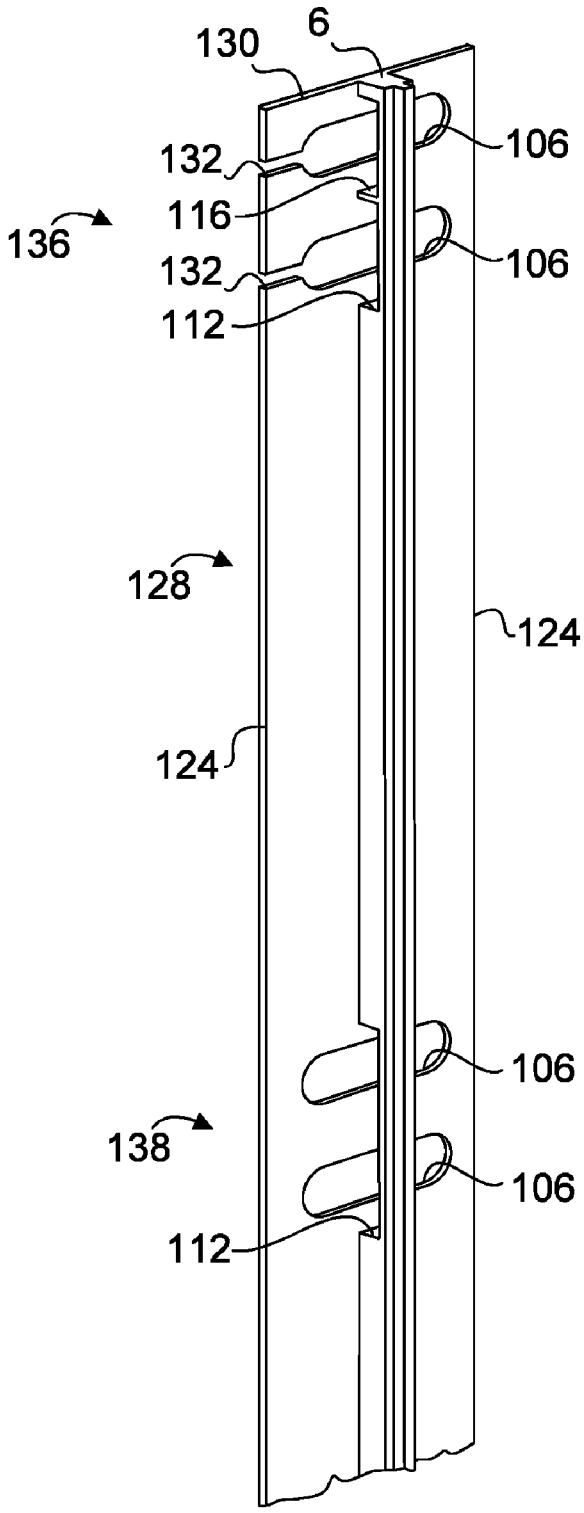
FIG. 33 is a front perspective view of a joint closure of a third embodiment.

FIG. 33 is a front perspective view of a joint closure of a third embodiment. This embodiment is configured for applications where bending of the joint closure 128 is not required. Two example configurations 136, 138 are shown to further contrast how securing and double securing plates 117, 118 may be used. The joint closure 128 comprises an elongated bottom plate 130 having a top surface, a width and two longitudinal edges 134. The joint closure 128 further comprises an elongated strip 6 similar to those disclosed elsewhere herein. The elongated strip 6 is centrally disposed atop the top surface of the elongated bottom plate 130. There is further provided a plurality of screw openings 106, each centrally disposed about the width of the elongated bottom plate 130. There is further provided a plurality of plate openings 112, each centrally disposed about one screw opening 106. Configuration 136 depicts two consecutive plate openings 112 having a divider 116 and suited for use with securing plates 117. Configuration 138 depicts two consecutive plate openings 112 that are connected and suited for use with double securing plates 118.

In one further embodiment (not shown), the joint closures of the first, second and third embodiments are used together to cooperatively mount one or more wall panels. For example, the first and second embodiments may be used on wall panels having curved edges while the third embodiment may be used on wall panels having only rectilinear edges.

It will be appreciated by those skilled in the art that while the invention has been described above in connection with particular embodiments the invention is not necessarily so limited and that numerous other embodiments, uses, modifications and departures from the embodiments, and uses may be made without departing from the inventive concepts.

I claim:

1. A removable wall panel mounting system for mounting at least one wall panel to a wall, the at least one wall panel having a front face, a rear face and at least one first attachment portion attached to a portion of the rear face thereof, comprising:

at least one second attachment portion;

at least one joint closure having:

an elongated strip having a longitudinal axis and a substantially rectangular cross-sectional profile including a top wall, a bottom wall and two side walls connecting said top wall to said bottom wall;

a plurality of pairs of flanges, said plurality of pairs of flanges is disposed symmetrically about the longitudinal axis of said strip, each flange is an isosceles trapezoid comprising an outer base, a weakened base and two inwardly pointing sides, each extending from each end of said weakened base, wherein said weakened base is connected to a portion of one of said two side walls and each flange extends perpendicularly therefrom; a plate opening connecting said two side walls and centrally disposed about each pair of flanges;

a screw opening centrally disposed about each pair of flanges; and at least one securing plate having a centrally disposed aperture, said at least one second attachment portion is disposed on a lengthwise end of said at least one securing plate, wherein said at least one securing plate is disposed in said plate opening, wherein said at least one joint closure is secured to the wall by fastening at least one fastener through said aperture of said at least one securing plate and through said screw opening into the wall such that said joint closure is capable of adjustment with respect to said at least one securing plate, said at least one first attachment portion is configured to be removably attachable to said at least one second attachment portion by a pushing force applied substantially normal to the wall on the front face of the at least one wall panel to generate a tensile attachment pressure to attach the at least one wall panel to said joint closure, said elongated strip cooperates with the inwardly pointing sides of each said flange to accommodate bending while providing sufficient rigidity to said at least one joint closure, and said at least one joint closure is abutted with the at least one wall panel.

2. The removable wall panel mounting system of claim 1, wherein at least one flange of said plurality of pairs of flanges further comprises a channel connecting said screw opening to said outer base of said at least one a flange of said plurality of pairs of flanges.

3. The removable wall panel mounting system of claim 1, wherein said tensile attachment pressure ranges from about 50 pounds to 75 pounds per square inch of said at least one first attachment portion.

4. The removable wall panel mounting system of claim 1, wherein said at least one joint closure further comprises a substantially rectangular crown centrally disposed on said top wall.

5. The removable wall panel mounting system of claim 1, wherein said at least one first attachment portion comprises an attachment surface and a support surface, said attachment surface of said at least one first attachment portion is constructed from reclosable fasteners and said support surface of said at least one first attachment portion is coated with adhesive.

6. The removable wall panel mounting system of claim 1, wherein said second attachment portion comprises an attachment surface and a support surface, said attachment surface of said second attachment portion is constructed from reclosable fasteners and said support surface of the second attachment portion is coated with adhesive.

7. The removable wall panel mounting system of claim 1, further comprising at least one metal strip secured to the wall to provide secure backing to mount said at least one joint closure.

8. A removable wall panel mounting system for mounting at least one wall panel to a wall, the at least one wall panel having a front face, a rear face and at least one first attachment portion attached to a portion of the rear face thereof, comprising:

at least one second attachment portion;

at least one joint closure having:

an elongated bottom plate having a top surface, a bottom surface, a width and two longitudinal edges;

an elongated strip having a longitudinal axis and a substantially rectangular cross-sectional profile including a top wall, a bottom wall and two side walls connecting said top wall to said bottom wall, wherein said elongated strip is centrally disposed atop the top surface of said elongated bottom plate;

at least one screw opening centrally disposed about the width of said elongated bottom plate;

at least one plate opening connecting said two side walls and centrally disposed about said at least one screw opening; and at least one securing plate having a centrally disposed aperture, said at least one second attachment portion is disposed on a lengthwise end of said at least one securing plate, wherein said at least one securing plate is disposed in said plate opening, wherein said at least one joint closure is adjustably secured to the wall by fastening at least one fastener through said aperture of said at least one securing plate and through said screw opening into the wall such that said at least one joint closure is capable of adjustment with respect to said at least one securing plate, said at least one first attachment portion is configured to be removably attachable to said at least one second attachment portion by a pushing force applied substantially normal to the wall on the front face of the at least one wall panel to generate a tensile attachment pressure to attach the at least one wall panel to said joint closure, and said at least one joint closure is abutted with the at least one wall panel.

9. The removable wall panel mounting system of claim 8, further comprising at least a channel connecting said at least one screw opening to one of said two longitudinal edges of said elongated bottom plate.

10. The removable wall panel mounting system of claim 8, wherein said tensile attachment pressure ranges from about 50 pounds to 75 pounds per square inch of said at least one first attachment portion.

11. The removable wall panel mounting system of claim 8, wherein said at least one joint closure further comprises a substantially rectangular crown centrally disposed on said top wall.

12. The removable wall panel mounting system of claim 8, wherein said at least one first attachment portion comprises an attachment surface and a support surface, said attachment surface of said at least one first attachment portion is constructed from reclosable fasteners and said support surface of said at least one first attachment portion is coated with adhesive.

13. The removable wall panel mounting system of claim 8, wherein said second attachment portion comprises an attachment surface and a support surface, said attachment surface of said second attachment portion is constructed from reclosable fasteners and said support surface of the second attachment portion is coated with adhesive.

14. The removable wall panel mounting system of claim 8, further comprising at least one metal strip secured to the wall to provide secure backing to mount said at least one joint closure.

* * * * *